US007862022B2

(12) United States Patent
Kitahara

(10) Patent No.: US 7,862,022 B2
(45) Date of Patent: Jan. 4, 2011

(54) SHEET PROCESSING APPARATUS AND IMAGE FORMING APPARATUS

(75) Inventor: Yoshihiko Kitahara, Ushiku (JP)

(73) Assignee: Canon Finetech Inc., Misato-Shi (JP)

( * ) Notice: Subject to any disclaimer, the term of this patent is extended or adjusted under 35 U.S.C. 154(b) by 762 days.

(21) Appl. No.: 11/740,562

(22) Filed: Apr. 26, 2007

(65) Prior Publication Data

US 2007/0278732 A1 Dec. 6, 2007

(30) Foreign Application Priority Data

Apr. 28, 2006 (JP) ..... 2006-127114
Apr. 28, 2006 (JP) ..... 2006-127115

(51) Int. Cl.
*B65H 37/04* (2006.01)

(52) U.S. Cl. ..... 270/58.08; 270/58.07; 270/58.1; 270/58.12; 270/58.17

(58) Field of Classification Search ..... 270/32, 270/37, 58.07, 58.08, 58.09, 58.12, 58.17
See application file for complete search history.

(56) References Cited

U.S. PATENT DOCUMENTS 5,005,751 A * 4/1991 Radtke et al. ..... 227/111
5,090,673 A 2/1992 Kitahara et al. ..... 270/53
5,772,198 A * 6/1998 Yamamoto ..... 270/58.12
6,575,446 B2 * 6/2003 Wakabayashi et al. ... 270/58.07
6,779,790 B2 8/2004 Kitahara ..... 270/58.12
7,198,268 B2 * 4/2007 Yamada et al. ..... 271/303
2002/0060388 A1 * 5/2002 Wakabayashi et al. ... 270/58.08
2005/0225021 A1 * 10/2005 Yamada et al. ..... 270/37

FOREIGN PATENT DOCUMENTS

JP 11-348451 12/1999
JP 2000-169028 6/2000
JP 3215909 8/2001

* cited by examiner

*Primary Examiner*—Leslie A Nicholson, III
(74) *Attorney, Agent, or Firm*—Fitzpatrick, Cella, Harper & Scinto

(57) ABSTRACT

A sheet processing apparatus including: a saddle stitching stapler including a staple driving portion movable in a sheet width direction and a staple clinching portion arranged at a saddle stitching position, and adapted to staple a middle portion of a sheet bundle by causing the staple driving portion to approach the staple clinching portion after the staple driving portion moves to the saddle stitching position; and a side stitching stapler including a staple driving portion and a staple clinching portion pivoted to each other, and adapted to staple an end portion of the sheet bundle by holding the end portion between the staple driving portion and the staple clinching portion after the staple driving portion and the staple clinching portion move to a side stitching position in the sheet width direction, the side stitching stapler and the saddle stitching stapler being aligned in the sheet width direction.

5 Claims, 27 Drawing Sheets

| FIG. 25A |
| --- |
| FIG. 25B |

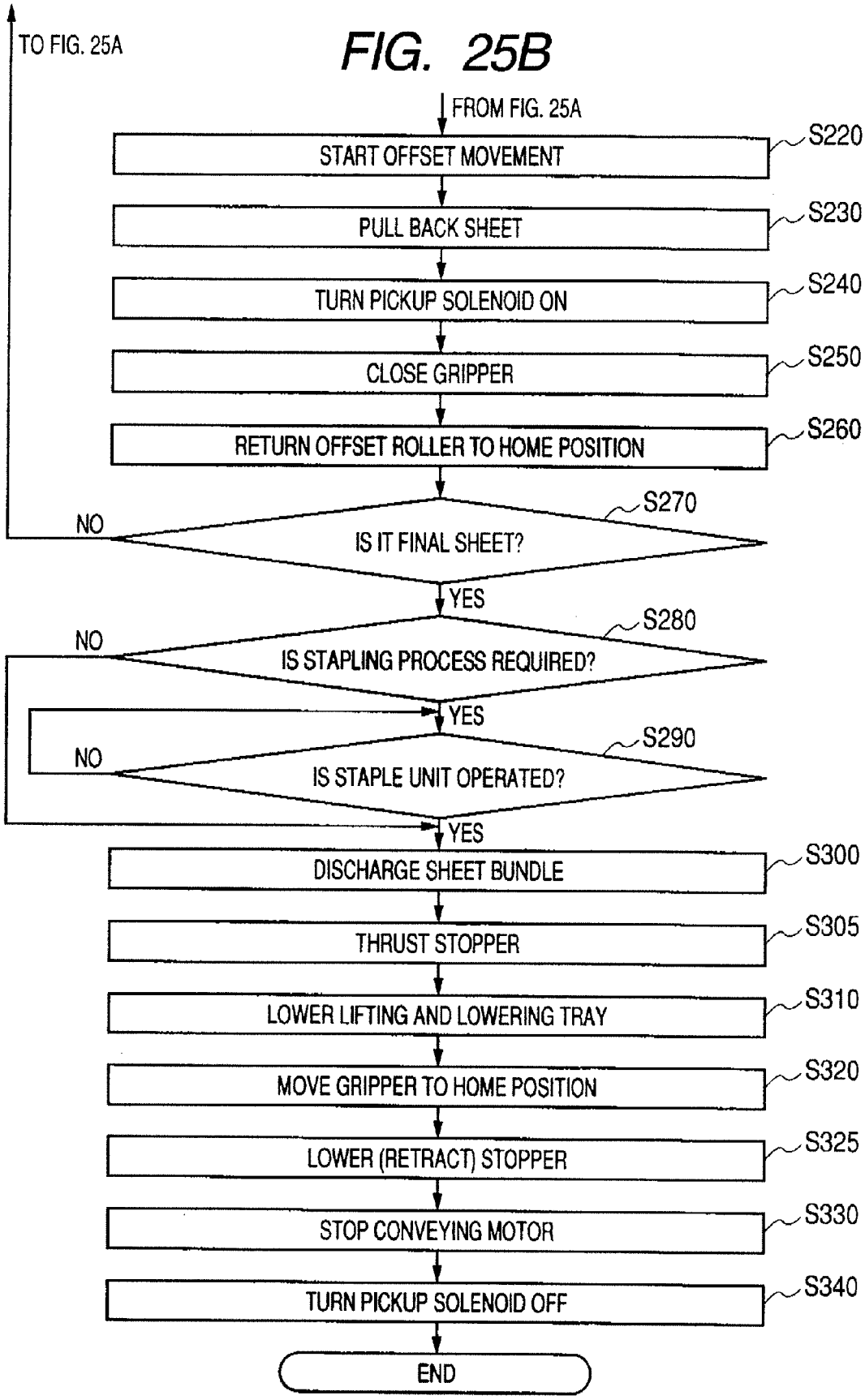
TO FIG. 25A
FIG. 25B
FROM FIG. 25A
START OFFSET MOVEMENT
S220
PULL BACK SHEET
S230
TURN PICKUP SOLENOID ON
S240
CLOSE GRIPPER
S250
RETURN OFFSET ROLLER TO HOME POSITION
S260
IS IT FINAL SHEET?
S270
NO
YES
IS STAPLING PROCESS REQUIRED?
S280
NO
YES
IS STAPLE UNIT OPERATED?
S290
NO
YES
DISCHARGE SHEET BUNDLE
S300
THRUST STOPPER
S305
LOWER LIFTING AND LOWERING TRAY
S310
MOVE GRIPPER TO HOME POSITION
S320
LOWER (RETRACT) STOPPER
S325
STOP CONVEYING MOTOR
S330
TURN PICKUP SOLENOID OFF
S340
END

SHEET PROCESSING APPARATUS AND IMAGE FORMING APPARATUS

BACKGROUND OF THE INVENTION

1. Field of the Invention

The present invention relates to a sheet processing apparatus for processing sheets and an image forming apparatus having the sheet processing apparatus in an apparatus main body.

2. Related Background Art

Conventionally, the apparatus main body of an image forming apparatus for forming images on sheets may be equipped, for example, with a sheet processing apparatus for stapling sheet bundles. Examples of the sheet processing apparatus are disclosed in Japanese Patent Application Laid-Open No. H11-348451 and Japanese Patent Application Laid-Open No. 2000-169028.

In the sheet processing apparatus disclosed in Japanese Patent Application Laid-Open No. H11-348451, a saddle stitching stapler serving as a first sheet processing unit for stapling a middle portion of a sheet bundle and a side stitching stapler serving as a second sheet processing unit for stapling an end portion of a sheet bundle are arranged so as to be spaced apart from each other in a sheet bundle conveying direction. The saddle stitching stapler and the side stitching stapler move in a width direction of a sheet bundle to staple the sheet bundle.

In the sheet processing apparatus disclosed in Japanese Patent Application Laid-Open No. 2000-169028, an end portion and the middle portion of a sheet bundle are selectively stapled by one stapler.

In general, a sheet bundle stapled at an end portion is not folded, so the number of sheets in such a sheet bundle can be large. Thus, in a side stitching stapler, a staple driving portion for driving staples into a sheet bundle and a staple clinching portion for receiving distal ends of staples protruding from the back surface of the sheet bundle and folding them, are pivoted so as to be capable of opening and closing, thereby achieving a firm structure.

Meanwhile, a sheet bundle stapled at a middle portion is folded for bookbinding, so the number of sheet contained therein is smaller than that in the case of a sheet bundle stapled at an end. Thus, the structure of a saddle stitching stapler is not so firm as that of a side stitching stapler. Further, in a saddle stitching stapler, in order to be capable of receiving a middle portion of a sheet bundle, the staple driving portion and the staple clinching portion are separated from each other, so it is rather difficult to attain a firm structure.

In the sheet processing apparatus disclosed in Japanese Patent Application Laid-Open No. H11-348451, a side stitching stapler and a saddle stitching stapler are selectively used according to a position where a sheet bundle is stapled. Thus, it is possible to staple an end portion of a sheet bundle containing a large number of sheets by the side stitching stapler. However, in the sheet processing apparatus disclosed in Japanese Patent Application Laid-Open No. H11-348451, two staplers are arranged so as to be spaced apart from each other in the sheet conveying direction, resulting in a rather large apparatus size.

Further, in the sheet processing apparatus disclosed in Japanese Patent Application Laid-Open No. H11-348451, in which two staplers are arranged so as to be spaced apart from each other in the sheet conveying direction, it is necessary to provide a drive source for moving the staplers in the sheet bundle width direction for each stapler, resulting in a rather large apparatus size.

In contrast, in the sheet processing apparatus disclosed in Japanese Patent Application Laid-Open No. 2000-169028, side stitching and saddle stitching are effected by a single stapler, so it is possible to achieve a reduction in apparatus size. However, for saddle stitching, the stapler is separated into a staple driving portion and a staple clinching portion, and, when stapling an end portion of a sheet bundle, it may occur that a sheet bundle with a large number of sheets cannot be stapled. In view of this, in the sheet processing apparatus disclosed in Japanese Patent Application Laid-Open No. 2000-169028, it might be possible to form the stapler in a firm structure, which, however, would lead to an increase in apparatus size which is another problem.

Japanese Patent No. 3215909 discloses a construction in which a sheet delivery unit and two side stitching staplers are formed into an integral unit on a movable board and in which the integral unit is caused to slide on a stationary board due to a slide rail and a slide roller by a drive force of a stepping motor. However, the staplers disclosed in Japanese Patent No. 3215909 are incapable of saddle stitching. Further, in the construction disclosed in Japanese Patent No. 3215909, it is impossible to form a side stitching stapler and a saddle stitching stapler into an integral unit.

Thus, there has been a demand for a sheet processing apparatus which is of a small size and which can reliably perform both side stitching and saddle stitching. Further, a similar problem is involved in a sheet processing apparatus for perforating a sheet bundle.

Further, an image forming apparatus equipped with such a sheet processing apparatus is inevitably of a large size.

SUMMARY OF THE INVENTION

It is an object of the present invention to provide a sheet processing apparatus in which a saddle stitching stapler and a side stitching stapler capable of moving in a sheet width direction are arranged in the sheet width direction to achieve a reduction in size.

An object of the present invention is to provide a sheet processing apparatus including: a saddle stitching stapler including a staple driving portion movable in a sheet width direction and a staple clinching portion arranged at a saddle stitching position in the sheet width direction, and adapted to staple a middle portion of a sheet bundle by causing the staple driving portion to approach the staple clinching portion after the staple driving portion moves to the saddle stitching position; and a side stitching stapler including a staple driving portion and a staple clinching portion pivoted to each other, and adapted to staple an end portion of the sheet bundle by holding the end portion between the staple driving portion and the staple clinching portion after the staple driving portion and the staple clinching portion move to a side stitching position in the sheet width direction, the side stitching stapler and the saddle stitching stapler being aligned in the sheet width direction.

In a sheet processing apparatus according to an embodiment of the present invention, the saddle stitching stapler and the side stitching stapler are aligned in the sheet width direction, so there is no need to increase the length of the sheet processing apparatus in a sheet conveying direction, thereby achieving a reduction in size of the sheet processing apparatus.

Another object of the present invention is to provide an image forming apparatus reduced in size by being provided with a small sheet processing apparatus.

Another object of the present invention is to provide an image forming apparatus including: an image forming portion for forming an image on a sheet; and the sheet processing apparatus described above for processing the sheet on which the image has been formed by the image forming portion.

An image forming apparatus according to another embodiment of the present invention is provided with a small sheet processing apparatus, so the image forming apparatus can be reduced in size.

Still another object of the present invention is to provide a sheet processing apparatus in which, by using a drive source of one sheet processing unit, another sheet processing unit is moved in a sheet width direction, thereby achieving a reduction in size.

Still another object of the present invention is to provide a sheet processing apparatus including: a first sheet processing unit movable in a sheet width direction and adapted to process a sheet; a second sheet processing unit movable in the sheet width direction and adapted to process the sheet; a driving unit for moving the first sheet processing unit in the sheet width direction; and a coupling unit for releasably coupling the first sheet processing unit and the second sheet processing unit with each other, in which the first sheet processing unit is coupled with the second sheet processing unit by the coupling unit, and moves the second sheet processing unit in the sheet width direction.

In a sheet processing apparatus according to another embodiment of the present invention, the first processing unit is coupled to the second processing unit by the coupling unit, and the second processing unit is moved in the sheet width direction to the sheet processing position, so one drive unit needs to be provided for moving the first and second sheet processing units in the sheet width direction, thereby achieving a reduction in size.

A further another object of the present invention is to provide an image forming apparatus reduced in size by being provided with a small sheet processing apparatus.

A further another object of the present invention is to provide an image forming apparatus including: an image forming portion for forming an image on a sheet; and the sheet processing apparatus de-scribed above for processing the sheet on which the image has been formed by the image forming portion.

An image forming apparatus according to another embodiment of the present invention is provided with a small sheet processing apparatus, so the image forming apparatus can be reduced in size.

Further features of the present invention will become apparent from the following description of exemplary embodiments with reference to the accompanying drawings.

BRIEF DESCRIPTION OF THE DRAWINGS

FIGS. 19A and 19B are diagrams illustrating operation of a mechanism for bringing rollers of a sheet bundle conveying roller pair into and out of contact with each other, in which FIG. 19A is a diagram illustrating a state where the rollers of the sheet bundle conveying roller pair are spaced apart from each other, and FIG. 19B is a diagram illustrating a state where the rollers of the sheet bundle conveying roller pair are held in press contact with each other.

FIGS. 20A and 20B are diagrams illustrating operation of a mechanism for bringing rollers of the low-pressure folding roller pair into and out of contact with each other, in which FIG. 20A is a diagram illustrating a state where the rollers of the low-pressure folding roller pair are spaced apart from each other, and FIG. 20B is a diagram illustrating a state where the rollers of the low-pressure folding roller pair are held in press contact with each other.

FIGS. 28A, 28B, and 28C are diagrams for illustrating operation of saddle stitching and folding a sheet bundle, in which FIG. 28A is a diagram illustrating how the sheet bundle is moved to the saddle stapler, FIG. 28B is a diagram illustrating how the sheet bundle is saddle-stitched, and FIG. 28C is a diagram illustrating how the stapled portion of the sheet bundle is folded.

DESCRIPTION OF THE EXEMPLARY EMBODIMENTS

In the following, a sheet processing apparatus and an image forming apparatus according to an embodiment of the present invention will be described.

The sheet width direction refers to a direction crossing the sheet conveying direction and extending along the surface of the sheet.

Figure 1:
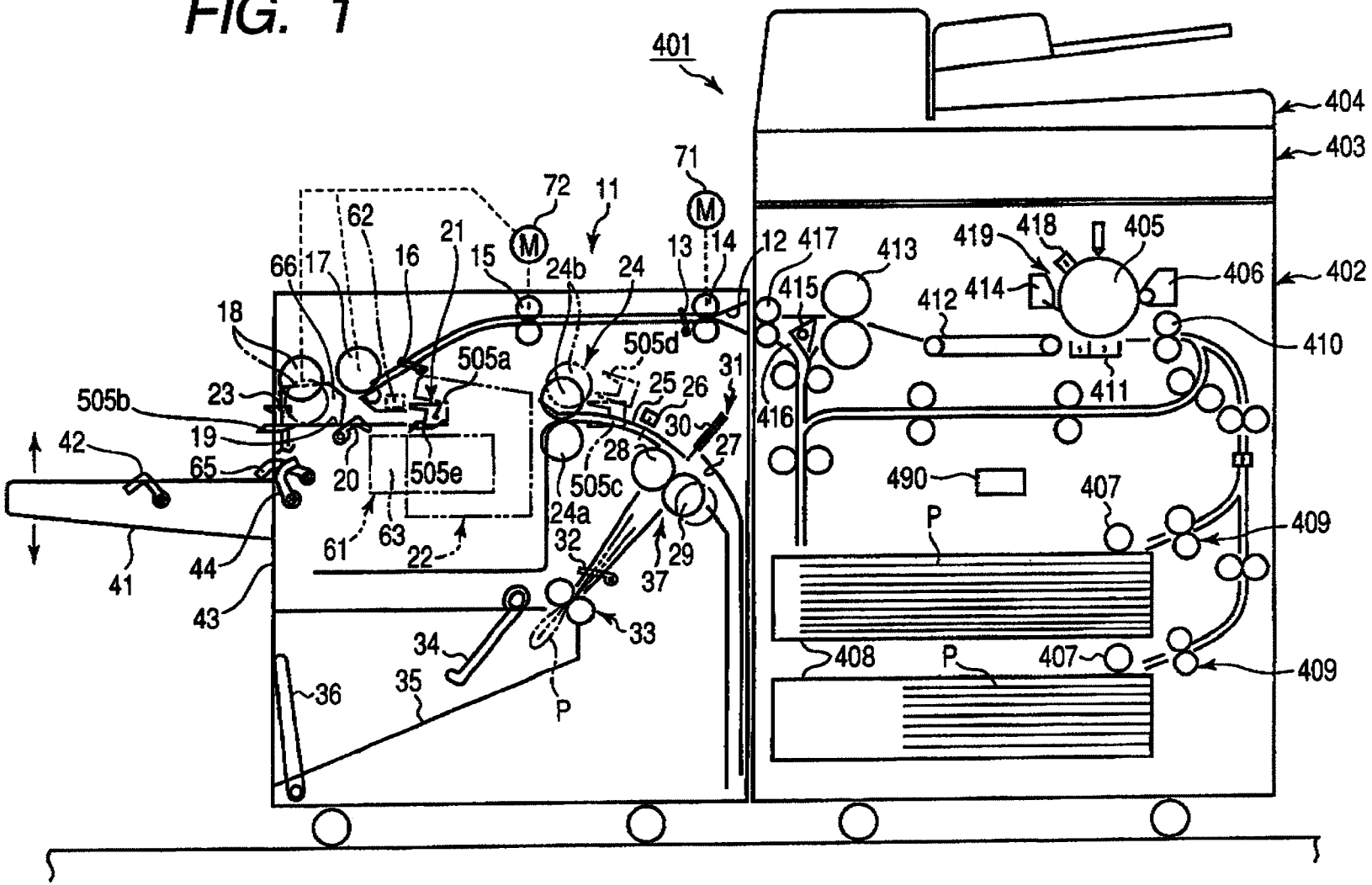
FIG. 1 is a sectional view of a copying machine taken along a sheet conveying direction, which is an example of an image forming apparatus according to an embodiment of the present invention.

In a copying machine 401 of FIG. 1, the sheet moves generally from the right-hand side to the left-hand side. Thus, the right-hand side is the upstream side, and the left-hand side is the downstream side. However, in a finisher 11, as it moves from a side stitching stapler 22 to a bundle stacking tray 35 by way of a folding device 31, the sheet first moves from the left-hand side to the right-hand side, and then moves downwards.

Thus, as far as this portion is concerned, the left-hand side is the upstream side, and the right-hand side is the downstream side.

(Image Forming Apparatus)

FIG. 1 is a sectional view, taken along the sheet conveying direction, of an image forming apparatus according to an embodiment of the present invention, such as a copying machine. Examples of the image forming apparatus include a copying machine, a printer, a facsimile apparatus, and a composite apparatus thereof. The present invention is not restricted to a copying machine.

The copying machine 401 has an image reading apparatus 403 on top of an apparatus main body 402 and, further, on top of the same, an automatic document feeder 404 which is capable of opening and closing. Connected to the apparatus main body 402 is the sheet processing apparatus, e.g., the finisher 11. It is not necessary for the copying machine 401 to be equipped with the image reading apparatus 403 and the automatic document feeder 404. It is also possible for the copying machine 401 to form an image on a sheet based on image information transmitted from the exterior.

The image reading apparatus 403 reads an original fed from the automatic document feeder 404, and transmits image information to a controller (not shown). The controller forms an electrostatic latent image on a photosensitive drum 405 charged by a charger 418 by using a laser beam scanner (not shown).

The electrostatic latent image is toner-developed by a developing device 406 to become a toner image. The photosensitive drum 405, the developing device 406, etc. constitute an image forming portion 419.

Each of sheet supply rollers 407 sends out a sheet P accommodated in cassettes 408 from the cassettes 408. Each of conveying roller pairs 409 sends the sheet to a pair of registration rollers 410.

The pair of registration rollers 410 receives the sheet while at rest, and generates deflection in the sheet, correcting skew feed of the sheet.

The pair of registration rollers 410 sends the leading edge of the skew-feed corrected sheet into the gap between the photosensitive drum 405 and a transfer device 411 in synchronism with the toner image on the photosensitive drum 405. The transfer device 411 transfers the toner image to the sheet. After that, a conveying belt 412 sends the sheet to a fixing device 413. The fixing device 413 fixes the toner image to the sheet by heating and pressurizing the sheet. The residual toner on the photosensitive drum 405 is removed by a cleaner 414.

After that, the sheet is reversed by a flapper 415 and a reversing and conveying path 416, and is sent into the finisher 11 by a discharge roller pair 417, with the image formation surface facing downwards.

The apparatus main body 402, the image reading apparatus 403, and the automatic document feeder 404 are controlled by an apparatus main body control portion 490.

(Finisher)

The finisher 11 will be schematically described.

The finisher 11 is equipped, for example, with a saddle stitching stapler 61 which is a first sheet processing unit for bundling sheets discharged from the apparatus main body 402 and stapling the middle of the sheet bundle, and the side stitching stapler 22 which is a second sheet processing unit for stapling an end portion of the sheet bundle. The finisher 11 is further equipped with the folding device 31 for folding the sheet bundle, etc. Instead of the saddle stitching stapler 61 and the side stitching stapler 22, it is also possible to provide punching devices of different kinds.

A conveyance guide pair 12 is composed of guide plates for receiving the sheet discharged from the discharge roller pair 417 of the apparatus main body 402 of the copying machine 401 and guiding it into the finisher 11. A sheet detecting sensor 13 is a sensor for detecting the sheet having entered the finisher 11.

An inlet conveying roller pair 14 rotated by an inlet motor 71 conveys the sheet guided by the conveyance guide pair 12. An intermediate conveying roller pair 15 receives the sheet conveyed by the inlet conveying roller pair 14, and conveys it. An alignment controlling sensor 16 detects the passing sheet, and operates a pickup solenoid 103 described below. The alignment controlling sensor 16 also serves as a sensor for providing an operational timing for a side alignment plate 66 described below. A discharge conveying roller pair 17 receives the sheet conveyed from the intermediate conveying roller pair 15, and conveys it further.

After the sheet has been discharged onto a processing tray 19 by the discharge conveying roller pair 17, an offset roller 18 descends onto the sheet as indicated by dashed lines, and presses the sheet against the processing tray 19 with a predetermined pressure. After the trailing edge of the sheet has left the discharge conveying roller pair 17, the offset roller 18 is reversed, and conveys the sheet to, for example, a reference wall 505*e* of a gripper 505, which serves as an alignment unit and as a gripping device for a gripper unit 21 situated at a home position. A sheet detecting sensor 20 is a sensor for detecting the presence/absence of a sheet on the processing tray 19.

The gripper 505 of the gripper unit 21 moves to the home position indicated by reference symbol 505*a*, a sheet bundle discharging position indicated by reference symbol 505*b*, a movement position indicated by reference symbol 505*c*, and a retracted position indicated by reference symbol 505*d*.

The side stitching stapler 22 staples an end portion of the sheet bundle aligned by the side alignment plate 66. When the gripper 505 moves to the sheet bundle discharging position 505*b* together with the gripper unit 21 to cancel the clamp, and then moves to the right, a trailing edge stopper 23 prevents it from protruding onto the processing tray 19 to move the sheet bundle to the right.

A sheet bundle conveying roller pair 24 conveys the sheet bundle conveyed by the gripper unit 21 to the folding device 31 described below. A curved fold conveyance guide pair 25 guides the sheet bundle. A fold controlling sensor 26 is a sensor for detecting the sheet bundle passing through the fold conveyance guide pair 25. When this sensor detects the sheet bundle, the folding device 31 is placed in a condition in which it can operate. A guide pair 27 is arranged in the extension of the fold conveyance guide pair 25, and guides the sheet bundle.

A thrusting member 30 thrusts the sheet bundle to force it into a nip of a low-pressure folding roller pair 37. The low-pressure folding roller pair 37 includes an upper folding roller 28 and a lower folding roller 29, and a nip thereof receives the sheet bundle thrust by the thrusting member 30, folding it while holding and rotating the same.

On the downstream side of the low-pressure folding roller pair 37, there is provided a fold sensor 32 for detecting the sheet bundle folded by the low-pressure folding roller pair 37. When the fold sensor 32 detects the sheet bundle, a high-pressure roller pair 33 arranged on the downstream side of the fold sensor 32 starts to operate. The high-pressure folding roller pair 33 holds and rotates the sheet bundle folded by the low-pressure folding roller pair 37, and discharges it onto the bundle stacking tray 35.

The sheet bundle discharged onto and stacked on the bundle stacking tray 35 is pressed against the bundle stacking tray 35 by a bundle presser 34 and received by a bundle stopper 36.

The sheet bundle discharged from the processing tray 19 is stacked on a lifting and lowering tray 41. The lifting and lowering tray 41 ascends and descends. The lifting and lowering tray 41 is equipped with a sheet presence/absence detecting sensor 42 for detecting any sheet stacked on the lifting and lowering tray 41.

A trailing edge guide 43 is a vertical surface for receiving the trailing edges of the sheets on the lifting and lowering tray 41. A sheet surface detecting sensor 44 is adapted to detect the upper surface of the lifting and lowering tray 41 on which no sheet or sheet bundle is stacked or the upper surface of a sheet or a sheet bundle stacked on the lifting and lowering tray 41. Due to the sheet surface detecting sensor 44, it is possible to maintain the sheet stack surface substantially at a fixed height. The saddle stitching stapler 61 includes a staple driving portion 63 for driving staples and a clincher 62 for receiving the staples driven from the staple driving portion 63 and clinching them.

A paper presser 65 is a member for clamping the sheets stacked on the lifting and lowering tray 41. The side alignment plate 66 is a member for aligning side edges of the sheets stacked on the processing tray 19.

In the following, each part of the finisher will be described in detail.

(Sheet Intermediate Discharging Portion)

The offset roller will be described with reference to FIGS. 1 through 3.

The offset roller 18 and the portion around the same will be described. FIG. 2 is an enlarged view of the offset roller 18 of FIG. 1 and the portion around the same. FIG. 3 is a perspective view of the offset roller 18 and the portion around the same.

The cylindrical offset roller 18 has in its outer periphery a portion formed of an elastic material such as rubber or a foam material whose elasticity is akin to that of rubber. The offset roller 18 is rotatably provided at a rotation end of an offset roller holder 102 adapted to rotate vertically around an offset shaft 101 shown in FIGS. 2 and 3.

The offset roller 18 is adapted to be retracted to the position indicated by the solid line shown in FIG. 1, where it does not interfere with the sheet discharged onto the processing tray 19 by the discharge conveying roller pair 17. Through operation of the pickup solenoid 103, a solenoid arm 104, a lever holder 105, a separation lever 106, and an offset roller holder 102 are operated to thereby lift the offset roller 18.

Further, through rotation of a conveying motor 72 (see FIG. 1), the offset roller 18 makes normal and reverse rotation through a timing belt.

The operation of the offset roller 18 will be described.

In FIG. 1, when the alignment controlling sensor 16 detects a sheet conveyed, the pickup solenoid 103 is turned off. As a result, the offset roller 18 is lowered by its own weight while rotating in the sheet conveying direction, and lands on (comes into contact with) the sheets stacked on the processing tray 19. Then, the offset roller 18 conveys the sheets to the left as seen in FIG. 1 for a predetermined period of time; when a predetermined period of time further elapses, it conveys the sheets to the right. The sheets abut the reference wall 505*e* of the gripper 505 on standby on the right-hand side of the processing tray 19 of FIG. 1, and their right-hand side edges as seen in FIG. 1 are aligned.

Figure 3:
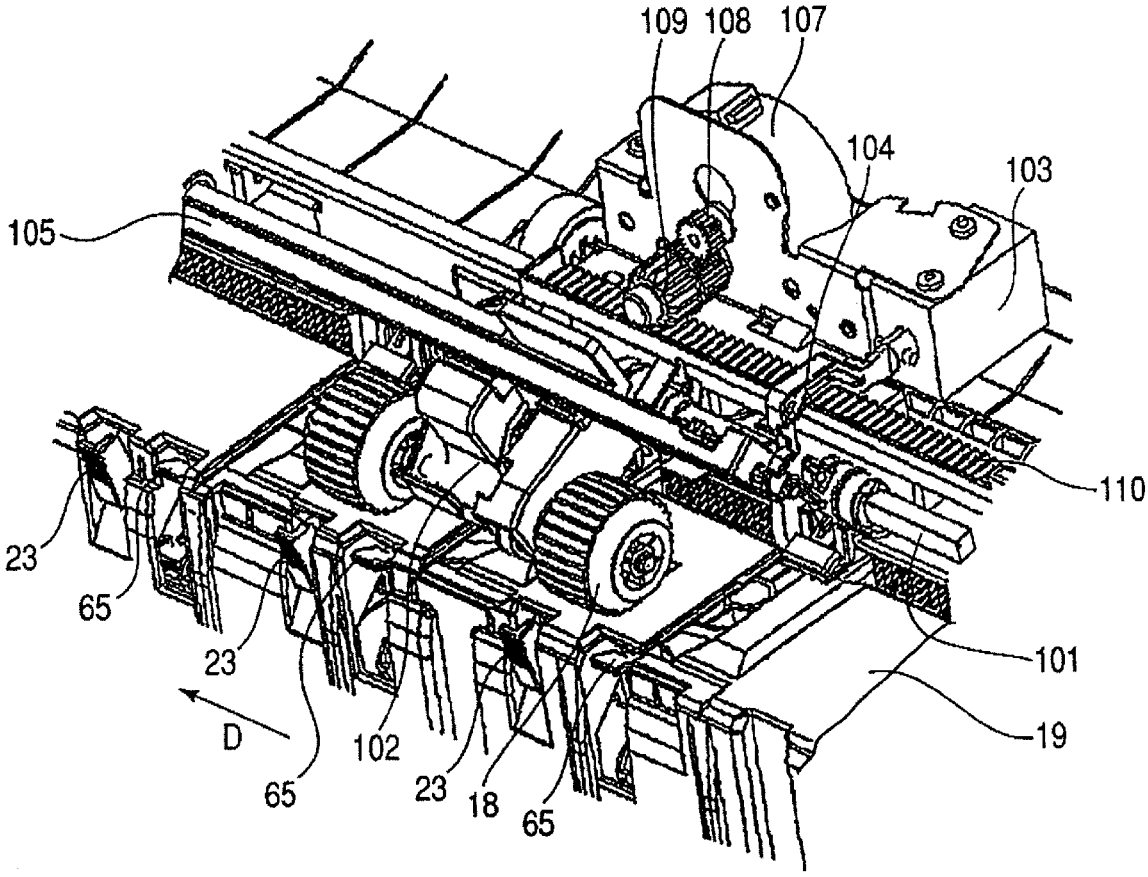
FIG. 3 is an enlarged perspective view of the offset roller and the portion in the vicinity thereof.

Further, in FIG. 3, by driving an offset motor 107, the offset roller 18 moves to the sheet width direction (direction of arrow D) through an offset motor gear 108, an offset pinion 109, and an offset rack 110, and approaches the side alignment plate 66.

When the offset roller 18 moves to approach the side alignment plate 66, the sheets, which have been in contact with the reference wall 505*e* of the gripper 505 and aligned in the conveying direction, are moved toward the side alignment plate 66 by the frictional force of the offset roller 18. Then, the other ends of the sheets abut the side alignment plate 66 to effect sheet width alignment. After sheets S have abutted the side alignment plate 66, the offset roller 18 moves through some distance on the sheet before stopping.

After the right-hand ends and the side edges of the sheets of FIG. 1 have been thus aligned, the right-hand end portion of the sheet bundle is stapled by the side stitching stapler 22. After that, the sheet bundle is moved to the left of FIG. 1 by the gripper unit 21. Then, the trailing edge stopper 23 is caused to protrude over the processing tray 19 by a stopper motor 848. The gripper unit 21 opens the gripper 505, and releases the sheet bundle before moving to the right of FIG. 1. At this time, the sheet bundle can be moved to the right by the gripper while placed on the gripper. However, the trailing edge stopper 23 protruding over the processing tray 19 receives the sheet bundle that would move to the right, and prevents movement of the sheet bundle to the right. As a result, the sheet bundle is discharged onto the lifting and lowering tray 41.

The sheet bundle discharged onto the lifting and lowering tray 41 is pressed against the lifting and lowering tray 41 by a sheet clamp member 65. The sheet clamp member 65 presses the sheet bundle also for the purpose of preventing the preceding sheet bundle from being pushed out by the succeeding sheet bundle when the succeeding sheet bundle is discharged.

(Gripper Unit)

The gripper unit 21 will be described with reference to FIGS. 4A and 4B and FIGS. 5 through 11.

Figure 4A:
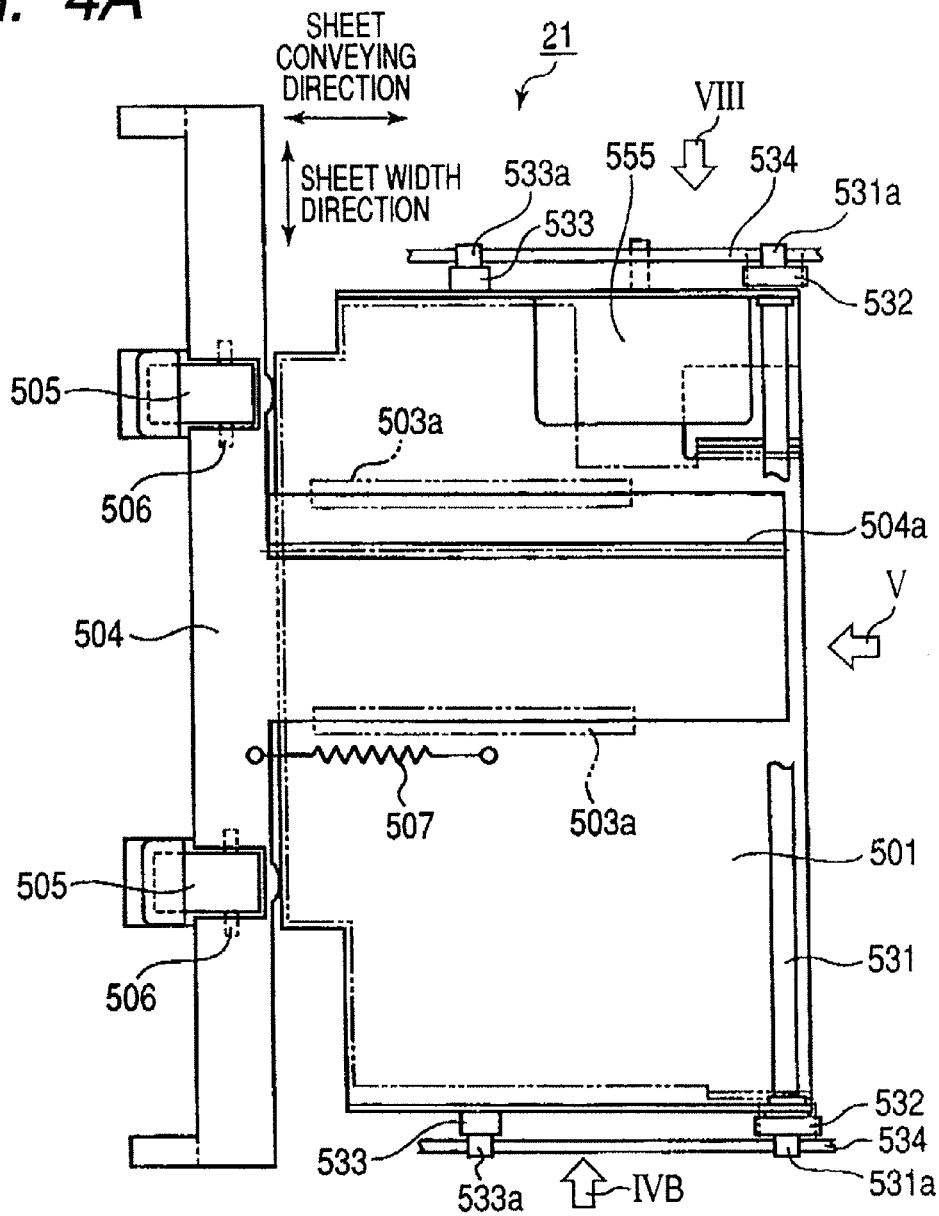
FIG. 4A is a plan view of a gripper unit.
Figure 4B:
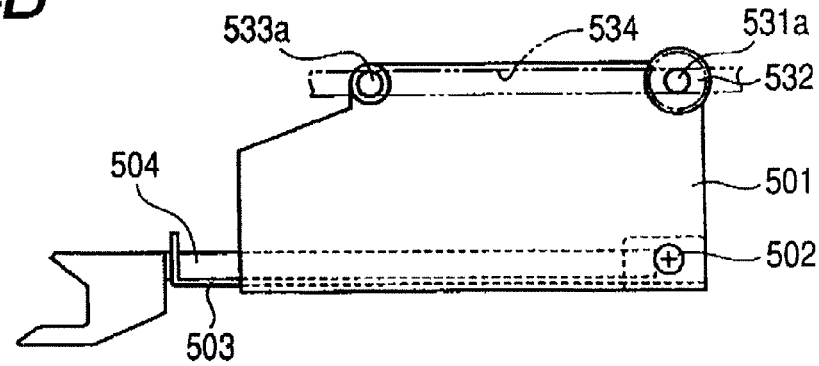
FIG. 4B is a diagram as seen in the direction of the arrow IVB of FIG. 4A.
Figure 5:
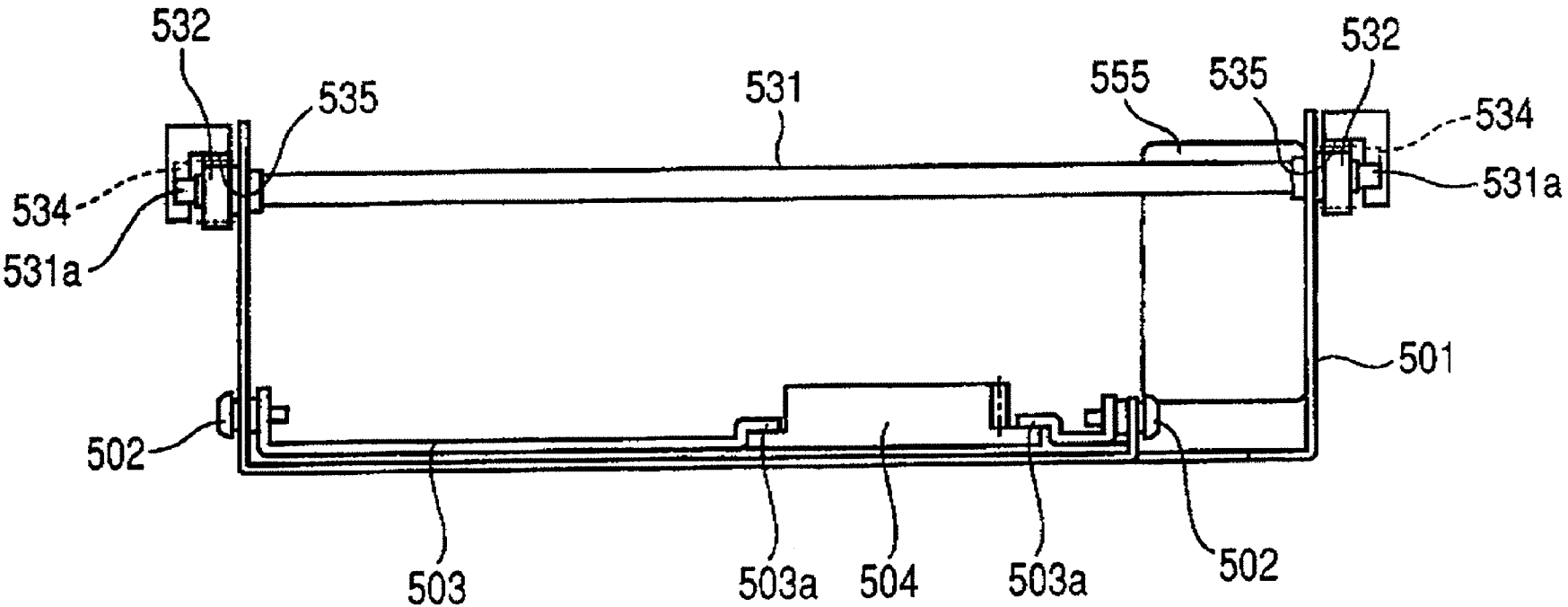
FIG. 5 is a diagram as seen in the direction of the arrow V of FIG. 4A.
Figure 6:
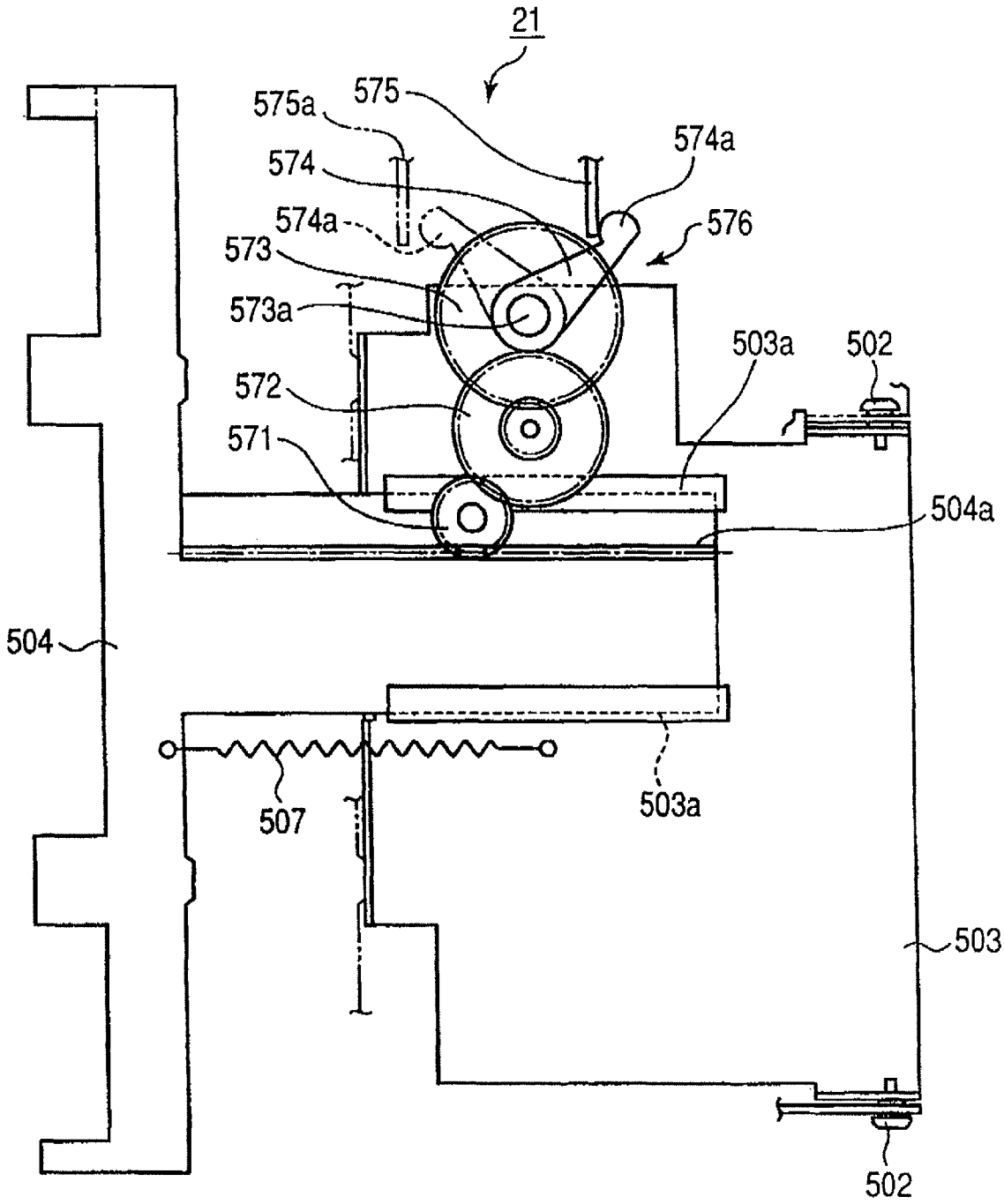
FIG. 6 is a plan view of a mechanism for increasing speed of a gripper arm.
Figure 7:
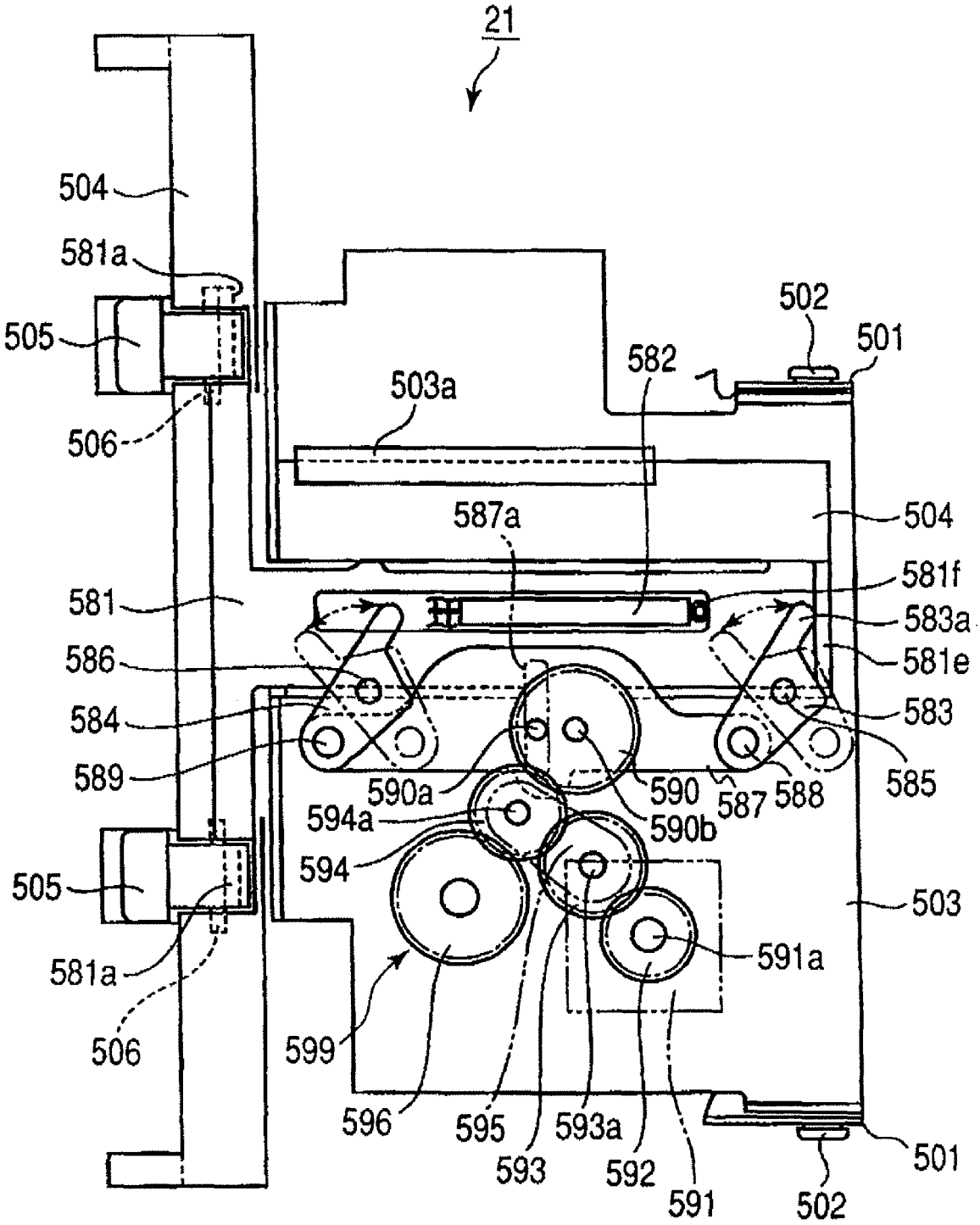
FIG. 7 is a plan view of a mechanism for opening and closing a gripper and a mechanism for vertically moving the gripper.
Figure 8:
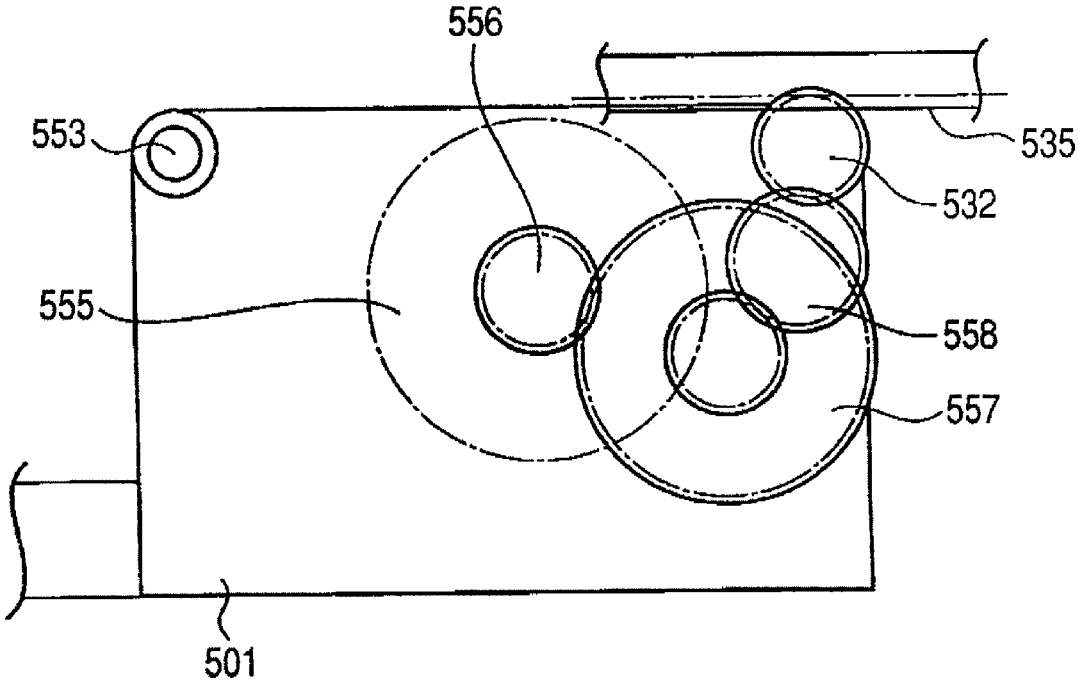
FIG. 8 is a diagram as seen in the direction of the arrow VIII of FIG. 4A.
Figure 9:
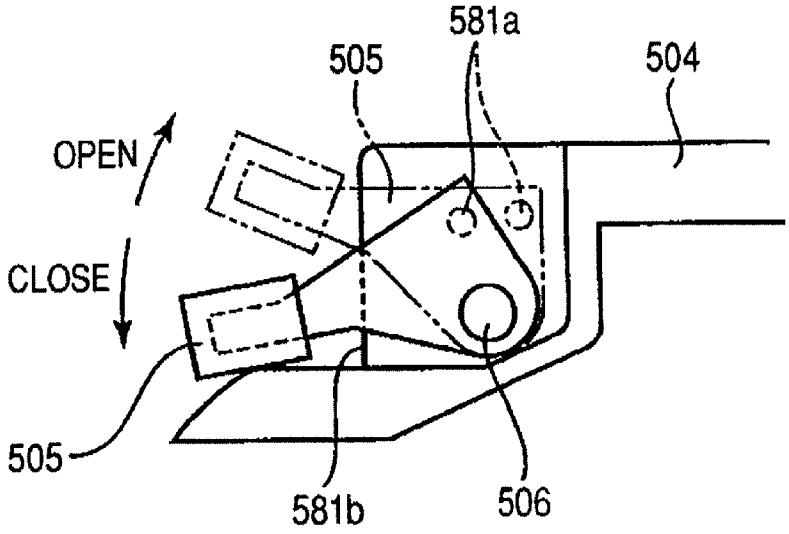
FIG. 9 is a diagram for illustrating a gripper opening/closing operation.
Figure 10:
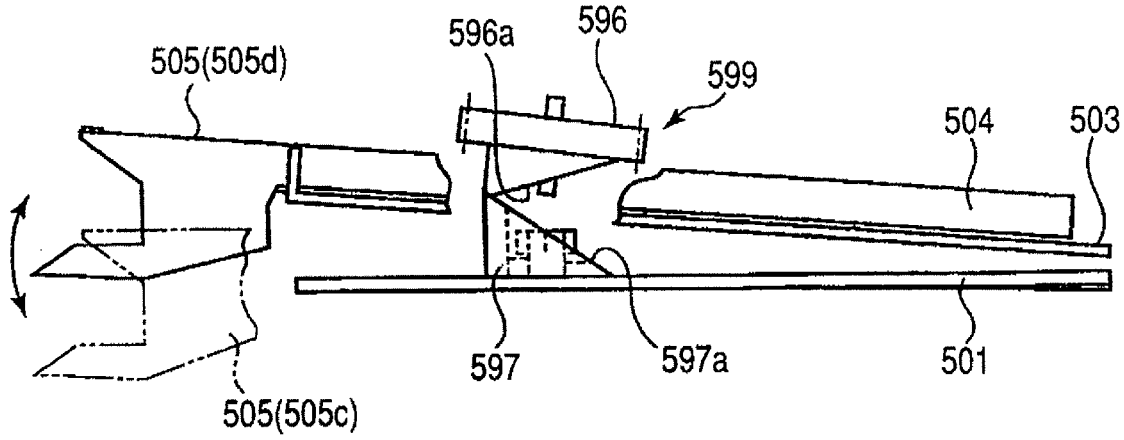
FIG. 10 is a front view of a mechanism for lifting and lowering the gripper.
Figure 11:
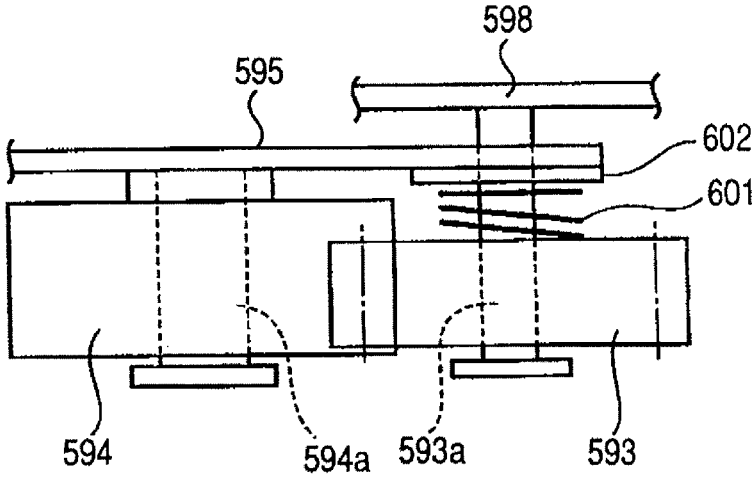
FIG. 11 is a diagram illustrating a portion shared by the mechanism for opening and closing the gripper and the mechanism for lifting and lowering the gripper.

FIGS. 4A and 4B illustrate the gripper unit. FIG. 4A is a plan view. FIG. 4B is a view as seen in the direction of an arrow IVB of FIG. 4A. FIG. 5 is a view as seen in the direction of an arrow V of FIG. 4A. FIG. 6 is a plan view of a gripper arm accelerating mechanism. FIG. 7 is a plan view of a mechanism for opening and closing the gripper and a mechanism for vertically moving the gripper. FIG. 8 is a view as seen in the direction of the arrow VIII of FIG. 4A. FIG. 9 is a diagram for illustrating a gripper opening/closing operation. FIG. 10 is a front view of a mechanism for lifting and lowering the gripper. FIG. 11 is a diagram illustrating portion shared by the mechanism for opening and closing the gripper and the mechanism for lifting and lowering the gripper.

Outer and inner gripper bases will be described.

In FIGS. 4A, 4B, and 5, an outer gripper base 501 is a base plate supporting the entire gripper unit 21; it is formed in a U-shape as seen in the sheet conveying direction. An inner gripper base 503 is provided on the inner side of the outer gripper base 501 so as to be rotatable around a fulcrum 502. On the inner gripper base 503, there is provided a gripper arm 504 described below which is movable in the sheet conveying direction. On the gripper arm 504, there is provided a gripper link 581 which is movable in the sheet conveying direction. The gripper 505 is provided on the gripper arm 504.

The mechanism for moving the gripper unit will be described.

In FIGS. 4A, 4B, 5, and 8, a drive shaft 531 rotatably supported by the outer gripper base 501 has drive gears 532 at both ends thereof. On the outer side of the outer gripper base 501, there protrudes outwardly a slide shaft 533. The end portions 533*a* of the slide shaft 533 and the end portions 531*a* of the drive shaft 531 are supported by elongated holes 534 formed in the frame of the finisher 11. The drive gears 532 are in mesh with racks 535 (see FIG. 8) fixed in position beside the elongated holes 534.

In FIGS. 4A and 8, a gripper unit driving motor 555 has a motor gear 556 on the rotation shaft thereof. The rotation of the gripper unit driving motor 555 is transmitted to one drive gear 532 through the motor gear 556 and idler gears 557 and 558. The drive force transmitted to one drive gear 532 is also transmitted to the other drive gear 532 through the drive shaft 531. As a result, the drive gears 532 provided at both ends of the drive shaft 531 are rotated while in mesh with the racks 535 to thereby move the gripper unit 21 as a whole in the sheet conveying direction.

The gripper arm will be described.

In FIGS. 4A, 4B, 5, and 6, the gripper arm 504 has the gripper 505 described below. The gripper arm 504 is provided on the inner gripper base 503 so as to be movable in the sheet conveying direction while guided by a pair of guide portions 503*a* formed by cutting and raising in the gripper base 503 so as to extend in the sheet conveying direction. The gripper arm 504 is constantly pulled to the right as seen in FIGS. 1, 4A, 4B, and 6 by a tensile spring 507 provided on the gripper arm 504 and the inner gripper base 503.

Formed on the gripper arm 504 shown in FIG. 6 is a rack 504*a*, which is in mesh with a gear 571. The gear 571 is in mesh with a double gear 572, which is in mesh with a large diameter gear 573. The gear 571, the double gear 572, and the large diameter gear 573 are rotatably provided on a support plate (not shown) that is integrated with the inner gripper base 503. An arm 574 is fixed to a shaft 573*a* of a large diameter gear 573. An arcuate abutment portion 574*a* is formed at the rotation end of the arm 574. The abutment portion 574*a* is adapted to abut an abutment plate 575 protruding from the frame of the finisher 11.

The operation when the gripper unit 21 moves to the left as seen in FIG. 1 will be described.

FIG. 4A is a plan view when the gripper unit 21 is at the home position; this position corresponds to the position indicated by reference symbol 505*a* in FIG. 1. FIG. 6 is a plan view when the gripper unit 21 is at the sheet bundle discharging position; this position corresponds to the position indicated by reference symbol 505*b* in FIG. 1.

When the gripper unit driving motor 555 shown in FIG. 4A rotates, the drive gear 532 is rotated by the gear row including the motor gear 556, and the idler gears 557 and 558 which are shown in FIG. 8. The drive gear 532 rotates on the rack 535. The outer gripper base 501 starts to move to the left as seen in FIGS. 1, 4A, and 6 while guided by the end portion 531*a* of the drive shaft 531 integrated with the drive gear 532 and the elongated hole 534 of the frame. When the gripper unit driving motor 555 is making reverse rotation, the outer gripper base 501 starts to move to the right.

When the outer gripper base 501 starts to move to the left, the inner gripper base 503 and the gripper arm 504 on the outer gripper base 501 also start to move to the left. That is, the entire gripper unit 21 starts to move to the left.

While the gripper unit 21 moves from the home position indicated by reference symbol 505*a* to the sheet bundle discharging position indicated by reference symbol 505*b*, the arm 574 at the position indicated by dashed lines abuts a stationary abutment plate 575*a* shown in FIG. 6.

While in FIG. 6 the gripper unit 21 is shown as stationary, with the abutment plate 575*a*, 575 moving, this is only for the purpose of clarifying the drawing, and it does not alter the fact that it is the gripper unit that moves, with the abutment plate being stationary.

As the gripper unit 21 moves, the positions of the arm 574 and the abutment plate 575 are changed to those indicated by the solid lines. That is, as the gripper unit 21 moves, the arm 574 abuts the stationary abutment plate, and rotates from the position indicated by the dashed lines to the position indicated by the solid lines. As the arm 574 rotates, the large diameter gear 573, the double gear 572, and the gear 571 rotate, and the gripper arm 504 with the rack 504*a* formed thereon moves on the inner gripper 503 to the left against the resilient force of the tensile spring 507.

Thus, as the gripper unit 21 moves to the left, the gripper 505 is moved to extend to the left by the large diameter gear 573, the double gear 572, and the gear 571. At this time, the gripper 505 moves on the gripper unit 21, so it moves faster than the gripper unit 21 itself.

The abutment plate 575, the arm 574, the large diameter gear 573, the double gear 572, the gear 571, the rack 504*a*, etc. form an expansion speed increasing mechanism 576.

After that, when the gripper unit 21 is moved to the right as seen in FIG. 6 through reverse rotation of the gripper unit driving motor 555, the arm 574 rotates from the position indicated by the solid lines to the position indicated by the dashed lines. However, the gripper arm 504, which is pulled by the tensile spring 507, returns to the home position shown in FIG. 4A.

The grippers will be described with reference to FIGS. 1, 4A, 4B, 7, 9, and 10. While in this embodiment the number of grippers is two, this should not be construed restrictively.

The gripper arm 504 is movable provided on the inner gripper base 501. At the forward end of the gripper arm 504 (left-hand end as seen in FIGS. 4A, 4B, and 9), there is provided a pin 581*a*. The pin 581*a* is directed in the sheet width direction, and supports the gripper 505 on the gripper arm 504 so as to allow it to tilt in the vertical direction. The gripper 505 is connected to the gripper link 581 by the connecting pin 581*a*.

When the gripper link 581 is moved on the gripper arm 504 in the sheet conveying direction by a mechanism described below, the gripper pin 505 is pulled or pushed by the connecting pin 581*a* and opens/rotates, using a fulcrum pin 506 as the fulcrum.

The mechanism for and the operation of moving the gripper link 581 on the gripper arm 504 to open/close the gripper will be described based on FIGS. 7, 10, and 11.

A tensile spring 582 is stretched between a spring peg 581*f* of the gripper link 581 and the gripper arm 504. The gripper link 581 is constantly pulled to the left as seen in FIG. 7 by the tensile spring 582, and an abutment portion 581*e* of the gripper link 581 is received by an upstream link 583, thus restricting movement to the left.

The upstream link 583 and a downstream link 584 rotate around shafts 585 and 586 protruding from the inner gripper base 503, respectively. The upstream link 583 has an abutment portion 583*a*. The abutment portion 583*a* is adapted to receive the abutment portion 583*e* formed at the rear end (right-hand end of FIG. 7) of the gripper link 581. The upstream link 583 and the downstream link 584 are connected by a connecting link 587 having at both ends thereof shafts 588 and 589, which are engaged with them. In the intermediate portion of the connecting link 587, there is formed an elongated hole 587*a* orthogonal to the moving direction of the gripper link 581.

The elongated hole 587*a* is engaged with a protrusion 590*a* protruding from a link gear 590. A gear 592 is fixed to a rotation shaft 591*a* of a gripper opening, closing, lifting, and lowering motor 591. The gear 592 is in mesh with a gear 593, and the gear 593 is in mesh with a gear 594. The gear 594 is in mesh with any one of the gear 590 and a gear 596. A rotation shaft 590*b* of the gear 590 and a rotation shaft 593*a* of the gear 593 are fixed to a drive plate 598 (see FIG. 11) fixed to the inner gripper base 503. A rotation shaft 594*a* of the gear 594 is fixed to a rotation plate 595. The rotation plate 595 is rotatably provided on the rotation shaft 593*a* of the gear 593. Between the rotation plate 595 and the gear 593, there are provided a compression spring 601 and a friction plate 602. When the gear 593 rotates, the rotation plate 595 is caused to rotate in the same direction as the gear 593 by the action of the compression spring 601 and the friction plate 602. When the gear 594 abuts one of the link gear 590 and the gear 596, the friction plate 602 and the rotation plate 595 slip, and the gear 593 continues to rotate, whereas the rotation plate 595 is restricted in its rotation.

FIG. 7 illustrates the condition when the gripper opening, closing, lifting, and lowering motor 591 rotates counterclockwise. In this condition, the abutment portion 583*a* of the upstream link 583 abuts the abutment portion 581*e* of the gripper link 581, and retains the gripper link 581 at the right-hand side position of FIG. 7 against the resilient force of the tensile spring 582. Thus, the gripper 505 rotates to the position indicated by the dashed lines in FIG. 9 and maintained in the open state.

When, in the state shown in FIG. 7, the gripper opening, closing, lifting, and lowering motor 591 further rotates counterclockwise, the link gear 590 is rotated clockwise through the gears 592, 593, and 594. Then, through engagement of the protrusion 590*a* of the link gear 590 and the elongated hole 587, the connecting link 587 moves to the right as seen in FIG. 7. As a result, the upstream link 583 and the downstream link 584 connected with the connecting link 587 are inclined from the positions indicated by the solid lines to the positions indicated by the dashed lines. Then, following the inclination of the upstream link 583, the gripper link 581 pulled to the left of FIG. 7 by the tensile spring 582 moves to the left, and causes the gripper 505 to rotate counterclockwise through the connecting pin 581*a* as shown in FIG. 9. As a result, the gripper 505 is closed by being rotated around the fulcrum pin 506 from the open position indicated by the dashed lines to the closed position indicated by the solid lines. The gripper opening, closing, lifting, and lowering motor 591 stops when the protrusion 590*a* has moved through rotation by 180 degrees. As a result, the gripper 505 is maintained at the closed position. As a result, the gripper 505 is maintained in the closed state. It is necessary to change the amount by which the gripper 505 is closed according to the thickness of the sheet bundle. In this connection, the gripper 505 of this embodiment is opened and closed through movement of the gripper link 581 pulled by the tensile spring 582, so, when the thickness of the sheet bundle is changed, it is possible to adjust the opening amount of the gripper 505 in correspondence with the change in the thickness of the sheet bundle through a change in the expansion amount of the tensile spring 582.

Referring to FIGS. 7 and 10, a vertical movement device 599 for vertically moving the inner gripper base 503 with respect to the outer gripper base 501, and the operation of the vertical movement device will be described.

The gear 596 is rotatably provided on the inner gripper base 503 and has a tapered surface 596*a* on the lower portion thereof. The gear 594 is releasably engaged with the gear 596. A tapered member 597 with a tapered surface 597*a* is fixed to the portion of the outer gripper base 501 opposed to the tapered surface 596*a* of the gear 596.

In FIG. 7, when the gripper opening, closing, lifting, and lowering motor 591 rotates clockwise, the gear 593 rotates counterclockwise, and the rotation plate 595 rotates counterclockwise in FIG. 7 around the shaft 593*a* of the gear 593. Further, the gear 596 in mesh with the gear 594 rotates. Then, as shown in FIG. 10, the tapered surface 596*a* of the gear 596 climbs up the tapered surface 597*a* of the tapered member 597, and the inner gripper base 503 is raised around a fulcrum 502 with respect to the outer gripper base 501. When the inner gripper base 503 has been raised to the uppermost position, the gripper opening, closing, lifting, and lowering motor 591 stops its rotation. As a result, the gripper 505 is raised from the position indicated by the dashed lines to the position indicated by the solid lines in FIG. 10.

To lower the gripper 505, the gripper opening, closing, lifting, and lowering motor 591 is further rotated clockwise.

This operation is conducted when moving the gripper 505 to the movement position 505*c* and the retracted position 505*d* of FIG. 1.

The vertical movement device 599 is formed by the gripper opening, closing, lifting, and lowering motor 591, the gears 592 and 593, the compression spring 601, the friction plate 602, the rotation plate 595, the gears 594 and 596, the tapered surfaces 596*a* and 597*a*, the tapered member 597, etc.

As the outer gripper base 501 moves, the inner gripper base 503 is lifted or lowered by climbing the stationary inclined surface provided on the frame of the finisher.

(Side Stitching Stapler)

Figure 12:
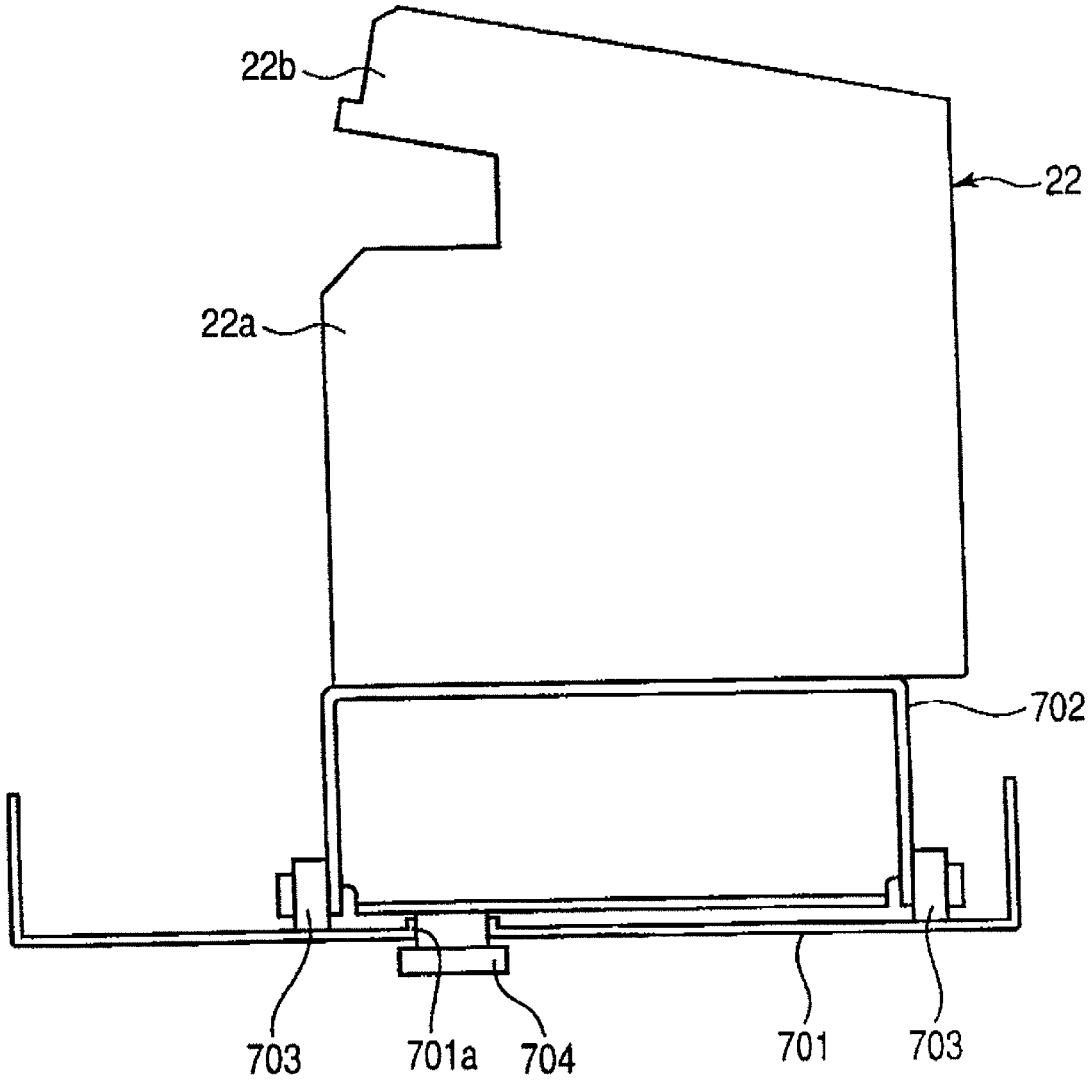
FIG. 12 is a front view of a side stitching stapler.
Figure 14:
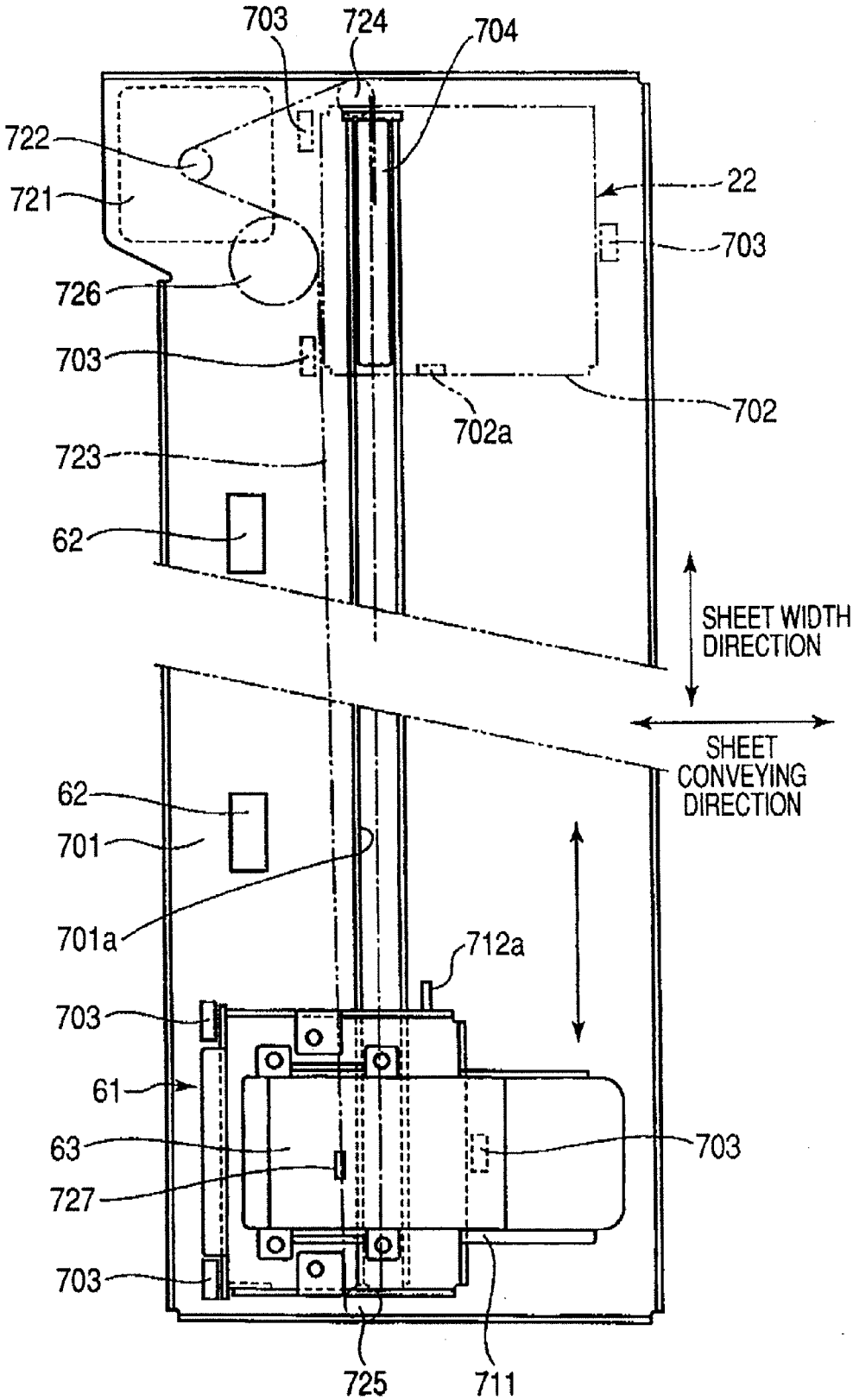
FIG. 14 is a plan view of the side stitching stapler and the saddle stitching stapler.
Figure 15:
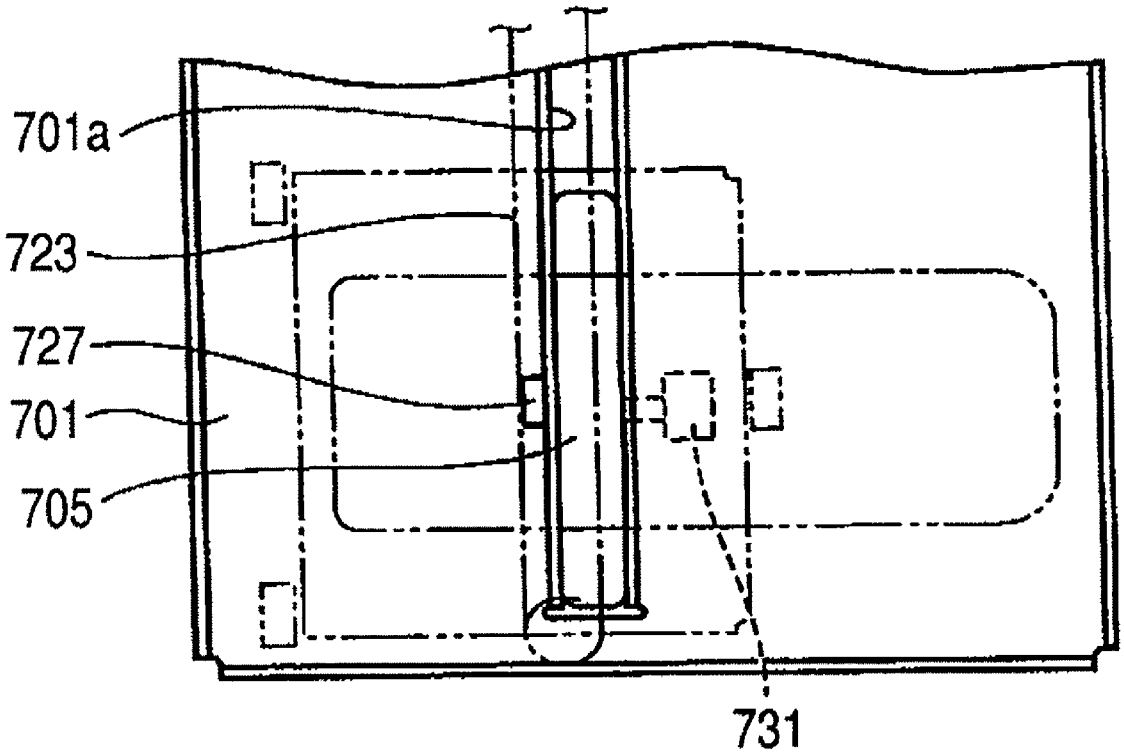
FIG. 15 is a plan view illustrating how a slider of the saddle stitching stapler is engaged with a rail.
Figure 26:
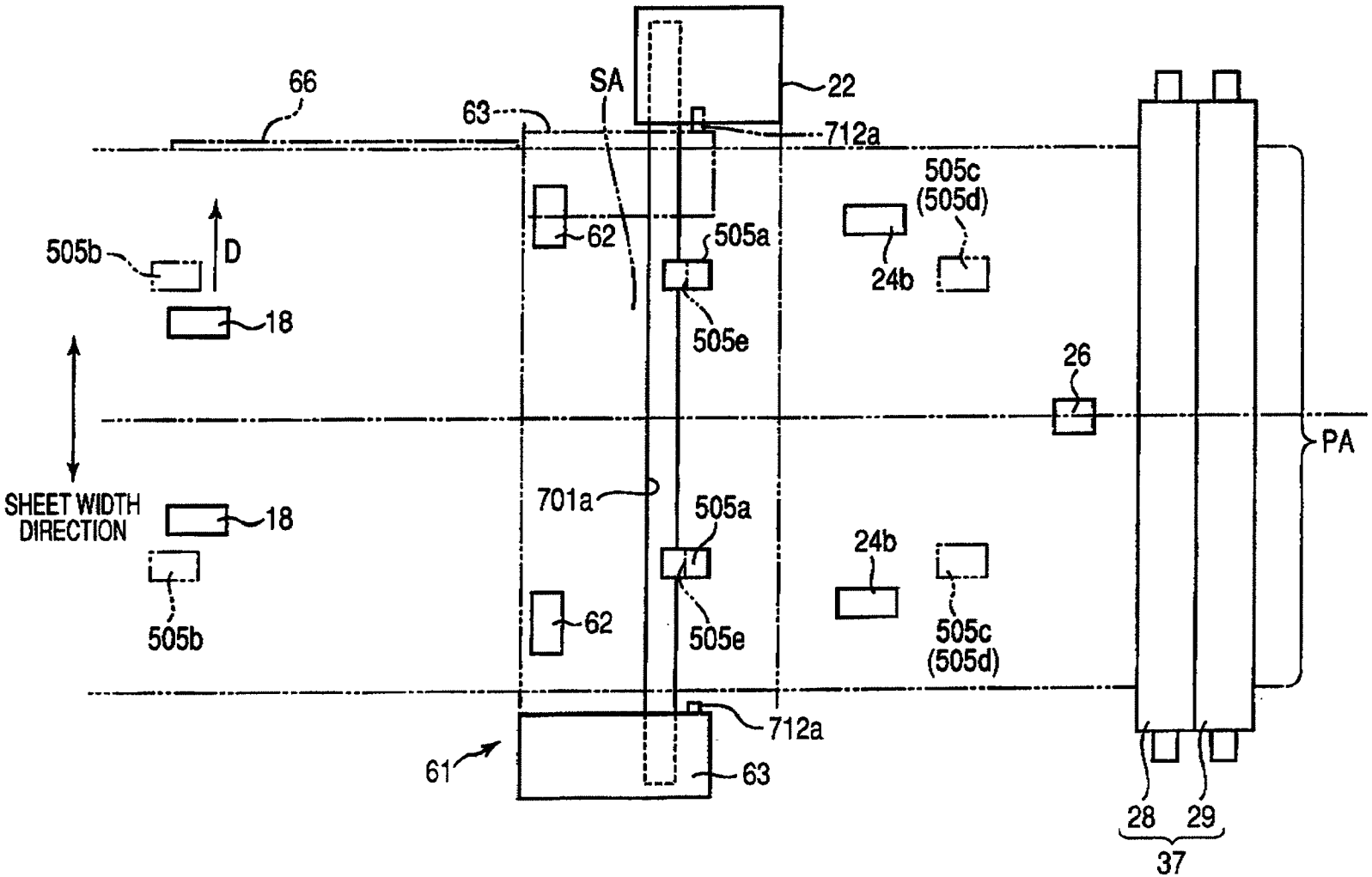
FIG. 26 is a plan view illustrating the positional relationship between the offset roller, the saddle stitching stapler, the side stitching stapler, and a grip.

The side stitching stapler 22 shown in FIGS. 12, 14, and 26 is adapted to staple the right-hand end portion of the sheet bundle of FIG. 1. The side stitching stapler 22 is formed by connecting together a staple driving portion 22*a* for passing a staple through the sheet bundle and a staple clinching portion 22*b* for receiving the forward ends of the staple passed through the sheet bundle and clinching the same. The side stitching stapler 22 can staple a sheet bundle by holding the sheet bundle between the staple driving portion 22 and the staple clinching portion 22*b*.

The side stitching stapler 22 can move on a stapler support base 701 while supported by runners 703 provided on a side stitching stapler stand 702. As shown in FIG. 26, the side stitching stapler 22 is generally on standby outside a sheet conveyance region PA. The sheet conveyance region PA is a region where the sheet passes. The side stitching stapler 22 can reciprocate in the sheet width direction while guided, for example, by a rail 701*a*, which is a guide unit for the stapler support base 701, and by a slider 704 engaged with the rail 701*a*. The side stitching stapler 22 cannot move of its own accord.

While the side stitching stapler 22 staples an end portion along the width direction of a sheet bundle (the right-hand end portion of FIG. 26), it is also possible to make it capable of stapling a corner of a sheet bundle on the retraction side. In this case, the side stitching stapler 22 is provided on the stapler stand 702 so as to be rotatable to oscillate along the surface of the sheet bundle. The horizontal rotation is effected by a motor (not shown).

(Saddle Stitching Stapler)

The saddle stitching stapler 61 will be described with reference to FIGS. 13A, 13B, 14, 15, and 16.

The saddle stitching stapler 61 has a staple driving portion 63 having a staple cartridge and a clincher 62, which is a portion for clinching staples. In FIGS. 14 and 26, the clincher 62 is fixed, for example, at two positions in the sheet width direction. The staple driving portion 63 moves to a position under the clincher 62 and moves upwards, then staples the sheet bundle in cooperation with the clincher 62. It is also possible for the position of the clincher 62 to be changed in the sheet width direction, A saddle stitching stapler stand 711 supporting the staple driving portion 63 is adapted to move on a stapler support base 701 while supported by multiple runners 703, The saddle stitching stapler 61 can reciprocate in the sheet width direction while guided by a rail 701*a* of the stapler support base 701 and a slider 704 engaged with the rail 701*a*.

The saddle stitching stapler stand 711 has vertical shafts 713 and 714, a lifting and lowering stand 712 lifted and lowered while guided by the vertical shafts 713 and 714, a saddle stapler motor 715, gears 717 and 718, etc. The lifting and lowering stand 712 is adapted to be lifted and lowered through rotation of a cam (not shown) through a gear 716 of the saddle stitching stapler motor 715 and the gears 717 and 718.

As shown in FIG. 26, the staple driving portion 63 is generally on standby outside the sheet conveyance region PA.

(Description of the Mechanism for Moving the Staplers and the Operation of this Mechanism)

In FIG. 14, a pulley 722 is fixed to a stapler shift motor 721, which is a driving unit on the stapler support base 701. A belt 723 is wrapped around the pulley 722 and idler pulleys 724, 725, and 726 on the stapler support base 701. The staple driving portion 63 is connected to the belt 723 by a coupling member 727.

The staple driving portion 63 of the saddle stitching stapler 61 is moved on the stapler support base 701 in the sheet width direction through support by the runners 703, rotation of the stapler shift motor 721, and guidance, for example, by the rail 701*a* and the slider 705 constituting the guide units, and is stopped directly below the clincher 62. The saddle stitching stapler 61 raises the staple driving portion 63 at the stop position to staple the sheet bundle by the staple driving portion 63 and the clincher 62.

The side stitching stapler 22 is connected to a connecting claw 712*a* provided on the staple driving portion 63 of the saddle stitching stapler 61, and is moved by the staple driving portion 63 of the saddle stitching stapler 61. Thus, it is possible to move the two staplers 61 and 22 by one stapler shift motor 721, thereby simplifying the structure of the finisher 11.

Figure 13B:
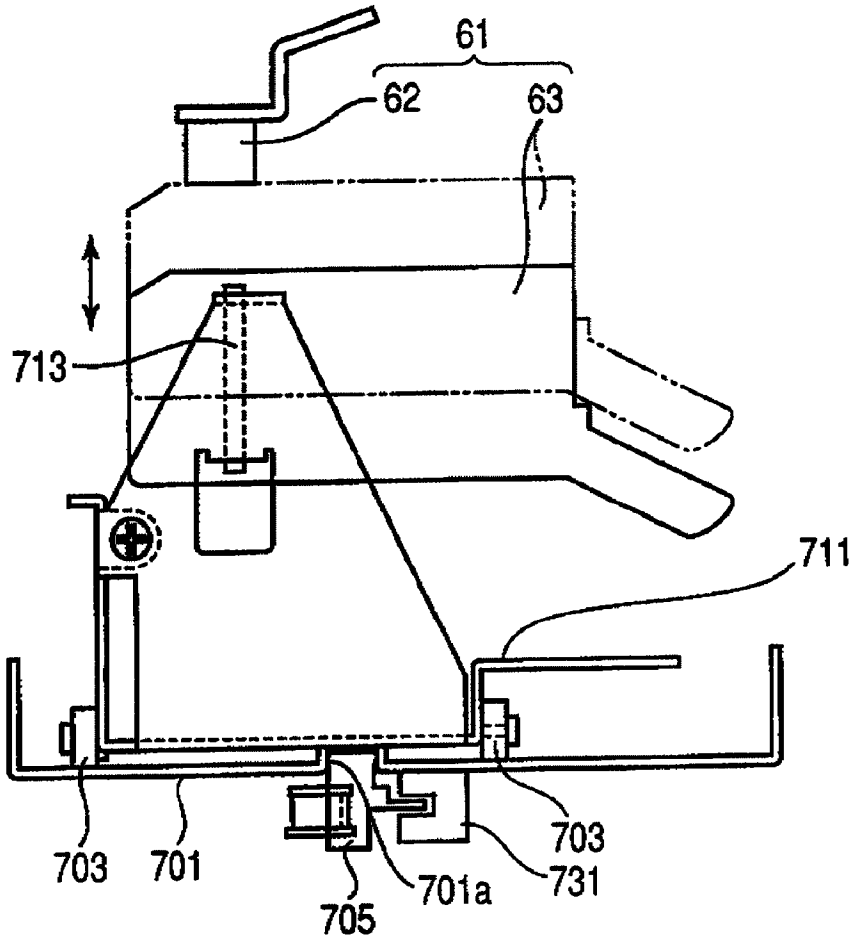
FIG. 13B is a side view of the saddle stitching stapler of FIG. 13A as seen from the right-hand side.

In FIG. 13B, a saddle stitching stapler home position sensor 731 detects a part of the slider 705, and effects positioning on the saddle stitching stapler 61 at the home position of FIG. 14.

Figure 13A:
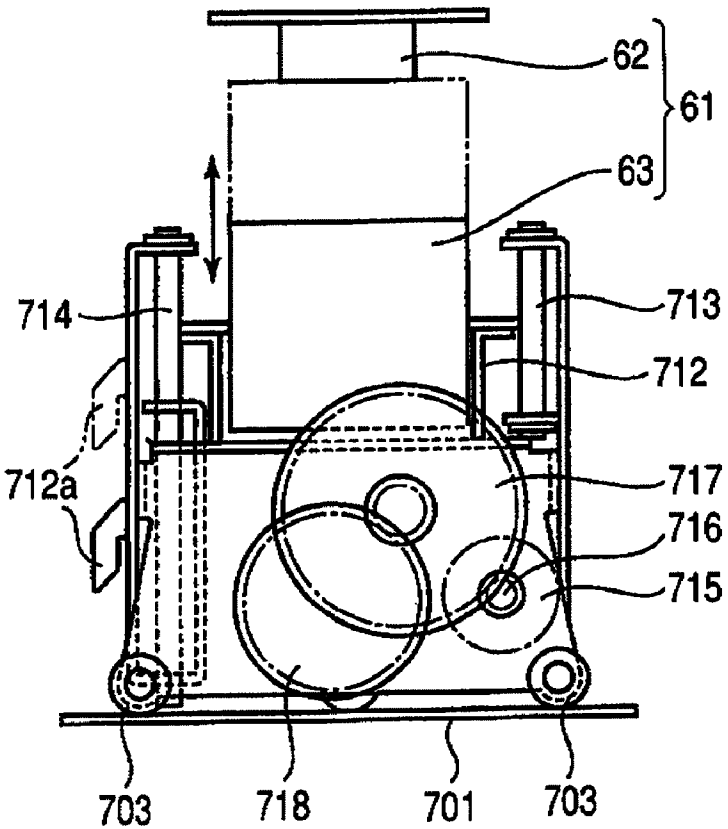
FIG. 13A is a side view of a saddle stitching stapler shown in FIG. 1 as seen from the left-hand side.

As shown in FIGS. 13A and 14, the connecting claw 712*a* protrudes on the side stitching stapler 22 side of the lifting and lowering stand 712, and is engaged with and disengaged from a coupled portion 702*a* of the side stitching stapler stand 702 of the side stitching stapler 22 as the lifting and lowering stand 712 is lifted and lowered. It is desirable for the lifting/lowering amount of the connecting claw 712*a* to be small enough not to cause the staple driving portion 63 to perform stapling operation.

The side stitching stapler 22 is prevented from being inadvertently moved in the sheet width direction by a click (not shown) arranged near the retracted position. The connecting claw 712*a* and the coupled portion 702*a*, which are the coupling members, are examples of the connection unit.

The clincher 62 of the saddle stitching stapler 61 is arranged on the lifting and lowering tray 41 side with respect to the side stitching stapler 22, whereby a reduction in the size of the apparatus can be achieved. If the clincher 62 were provided on the thrusting member 30 (described below) side with respect to the side stitching stapler 22, it would be necessary to provide the staple driving portion 63 of the saddle stitching stapler 61 on the thrusting member 30 side with respect to the side stitching stapler 22. In this arrangement, it would be impossible to cause the staple driving portion 63 of the saddle stitching stapler 61 and the side stitching stapler 22 to move on the common rail 701*a*, making it difficult to achieve a reduction in size.

(Folding Device)

Figure 19B:
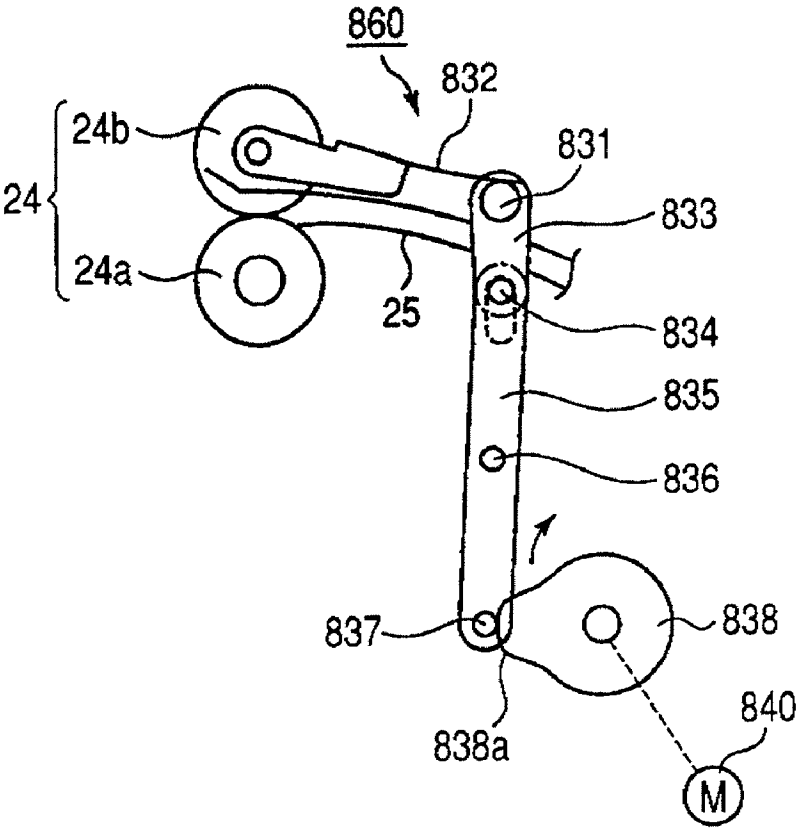

A conveying roller nip releasing device 860 for releasing the nip of the sheet bundle conveying roller pair 24 will be described with reference to FIGS. 19A and 19B.

The sheet bundle conveying roller pair 24 includes a lower roller 24*a* rotatably mounted to the frame (not shown) of the finisher 11, and an upper roller 24*b* upwardly retractable with respect to the lower roller 24*a*. The upward retracting of the upper roller 24*b* is effected by the conveying roller nip releasing device 860. The upper roller 24*b* is rotatably provided on a plate spring 832 fixed to a rotation center shaft 831, and rocks toward and away from the sheet.

A shorter press contact link 833 has the rotation center shaft 831 at one end and a connection shaft 834 at the other end. A longer press contact link 835 has a middle portion rotatably supported by a fulcrum 836, with one end thereof having an elongated hole engaged with the connection shaft 834. A shaft 837 protrudes from the other end thereof. The shaft 837 is in press contact with a cam 838 fixed to a cam shaft 839. The cam shaft 839 is rotated by a folding mechanism motor 840.

The sheet bundle conveying roller pair 24 are rotated by a common fold conveying motor 801 through a timing belt 811 for rotating the low-pressure folding roller pair 37 and the high-pressure folding roller pair 33; however, the sheet bundle conveying roller pair 24 may also be rotated by some other drive source. Thus, the sheet bundle conveying roller pair 24 is not always included in the folding device 31.

Figure 19A:
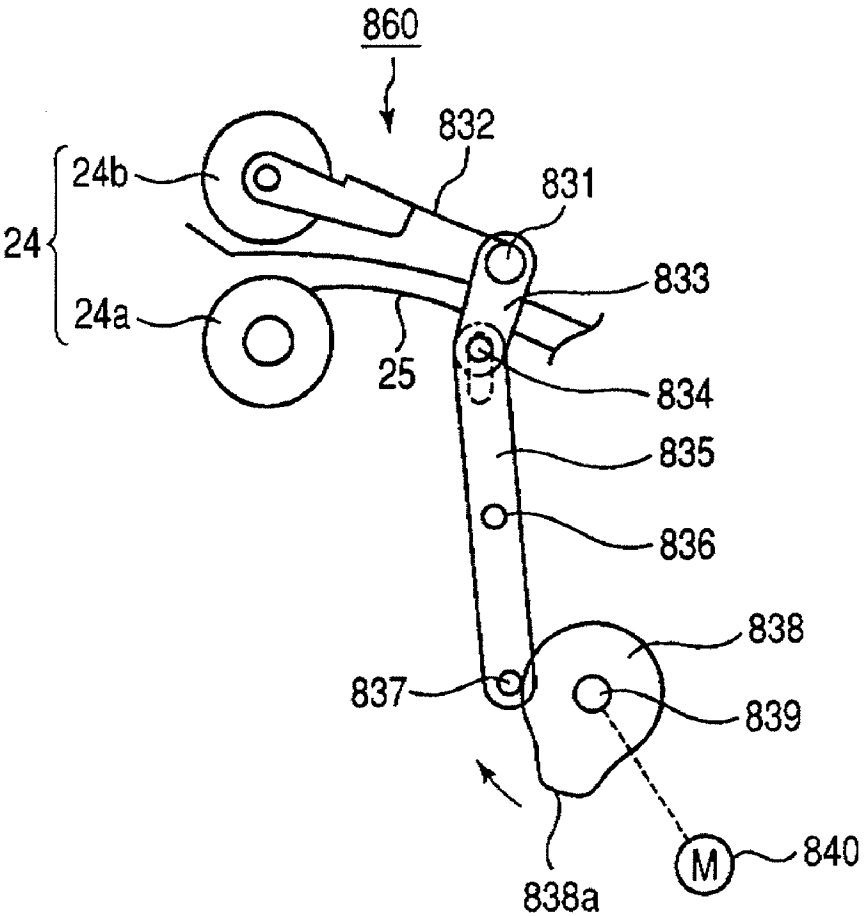

FIG. 19A is a diagram illustrating the state in which the upper roller 24*b* is at the home position.

The cam 838 is rotated in the direction of the arrow by the folding mechanism motor 840. A protrusion 838*a* of the cam surface causes the longer press contact link 835 and a short link 833 to tilt. As shown in FIG. 19B, the short link 833 brings the upper roller 24*b* into press contact with the lower roller 24*a* by utilizing the elasticity of the plate spring 832.

FIGS. 16, 17, 18A, and 18B show a roller operating portion 815 which separates the lower folding roller 29 from the upper folding roller 28 and switches the rotating direction. A gear 802 is fixed to a rotation shaft 801*a* of the fold conveying motor 801 of the roller operating portion 815. The gear 802 is in mesh with a gear 803. A rotation shaft 804 of the gear 803 is supported by a frame 864 of the finisher 11. Well-known one-way gears 805 and 806 are arranged on the shaft 804. The one-way gears 805 and 806 have locking directions opposite to each other.

The gear 805 is in mesh with a gear 809. The upper folding roller 28 is fixed to the gear 809. The one-way gear 806 is in mesh with an idler gear 808. The idler gear 808 is in mesh with the gear 809. The gear 803 is in mesh with a gear 807. The lower folding roller 29 is fixed to the gear 807.

Figure 16:
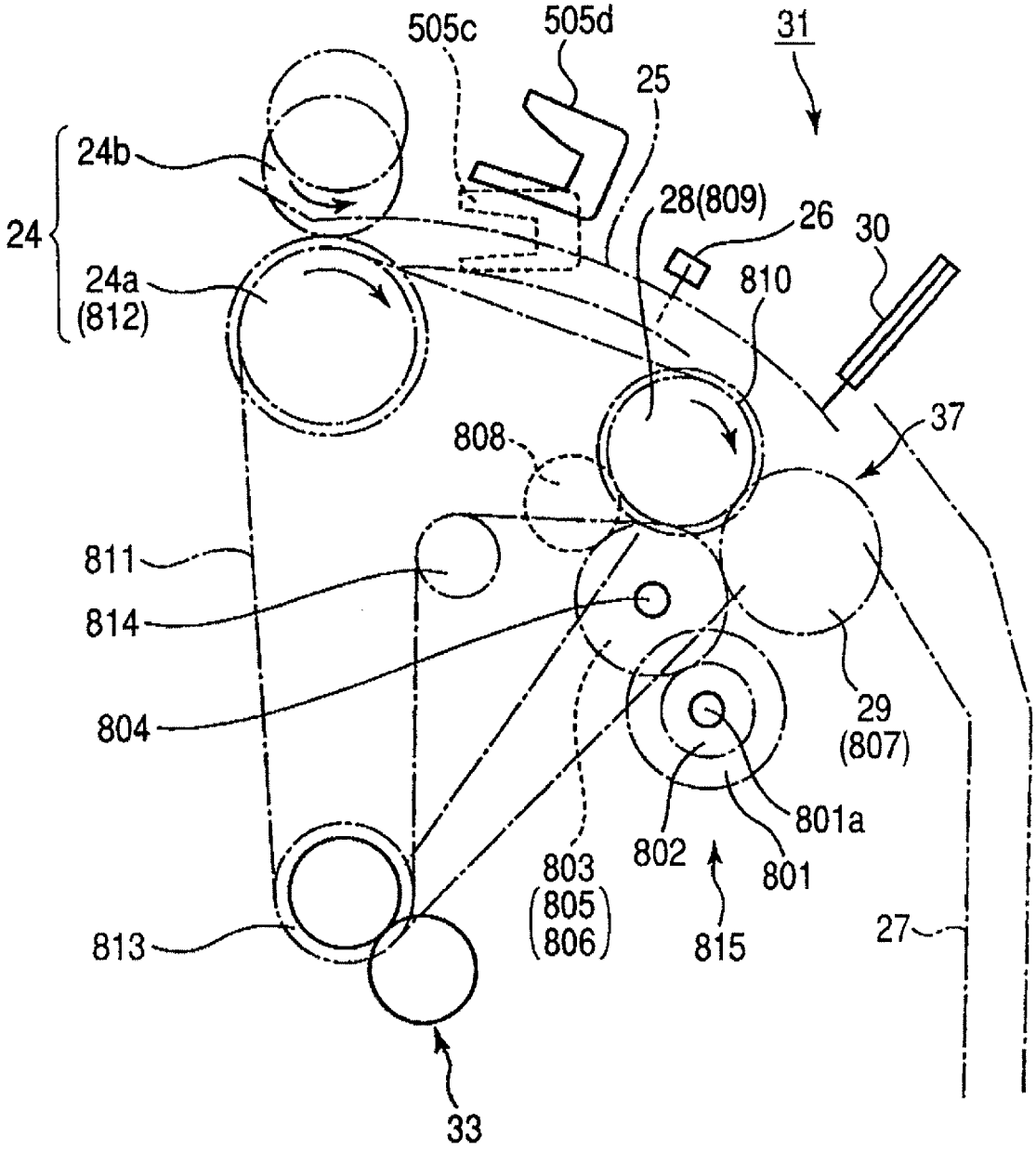
FIG. 16 is a front view of a folding device.
Figure 17:
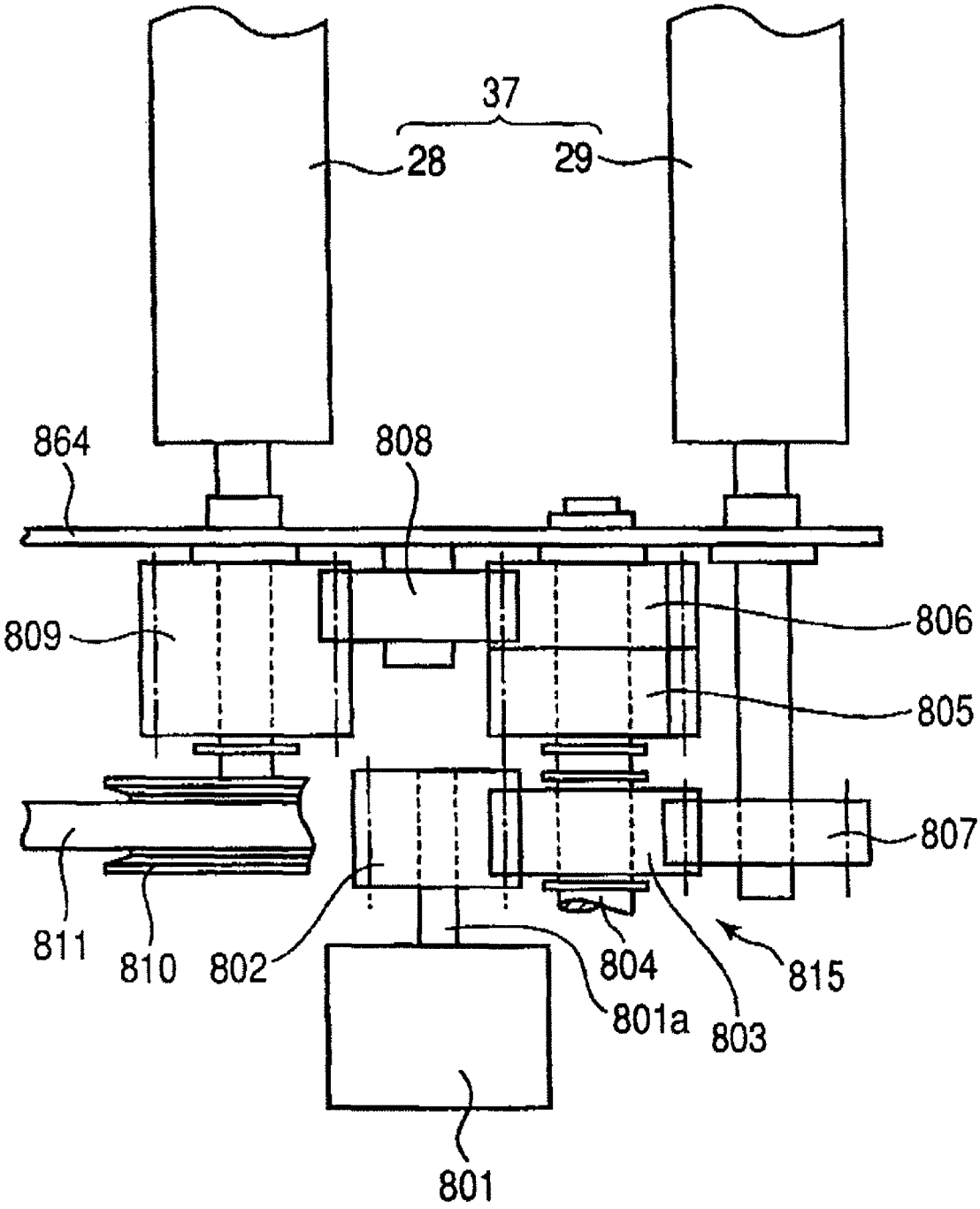
FIG. 17 is a diagram illustrating a portion driving a low-pressure folding roller pair.

A pulley 810 is fixed to the upper folding roller 28. In FIG. 16, a pulley 812 is fixed to the lower roller 24*a*. A pulley 813 is fixed to one of the rollers of the high-pressure folding roller pair 33. The timing belt 811 is wrapped around the pulley 810, the idler pulley 814, and the pulleys 812 and 813.

Figure 21C:
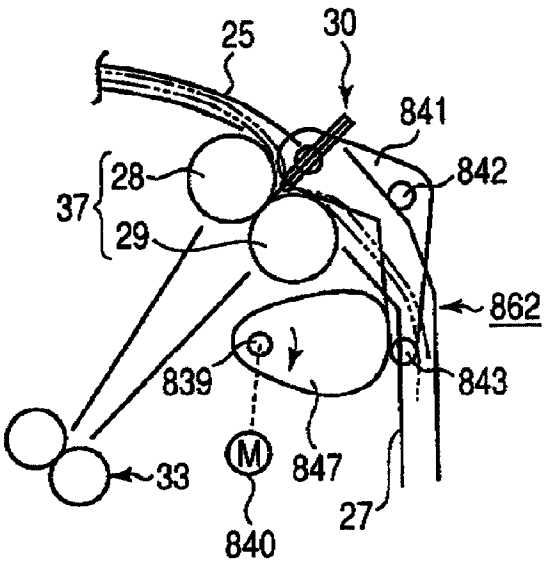
FIGS. 21A, 21B, and 21C are diagrams for illustrating operation of a mechanism for operating a thrusting member of a folding device.
Figure 21B:
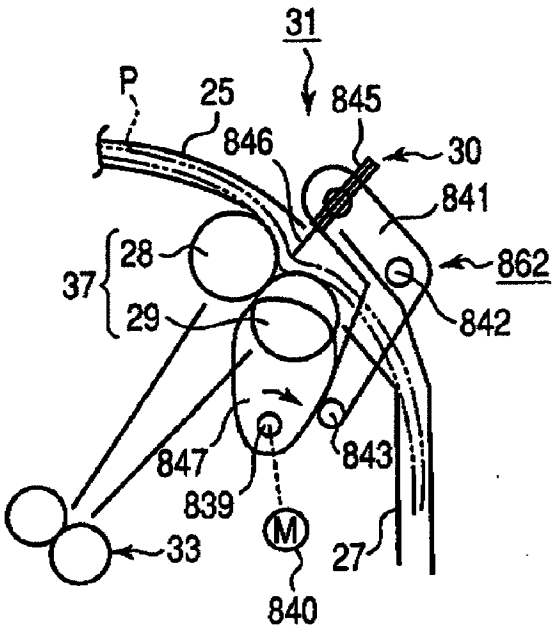
Figure 21A:
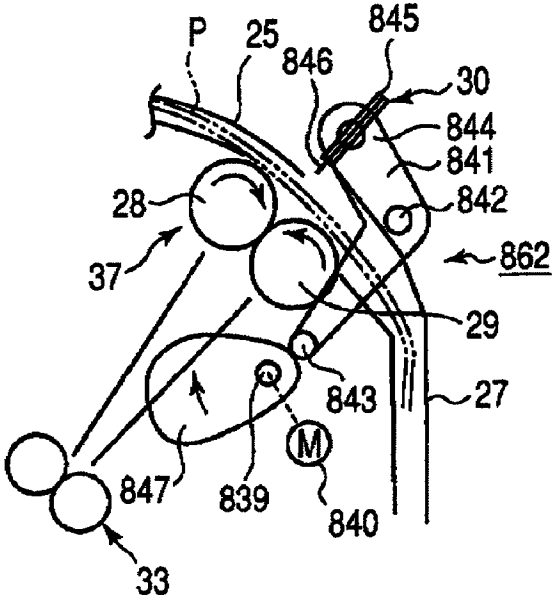

In FIGS. 21A, 21B, and 21C, a thrusting operation device 862 causes the thrusting member 30 to perform a thrusting operation.

A thrusting plate link 841 is provided on a rotation shaft 842. A shaft 843 is arranged on the thrusting plate link 841 at a position spaced apart from a rotation shaft 842, and is situated on the rotation path of a cam 847 so that the shaft 843 may be pressed by the cam 847 rotated by the cam shaft 839. A fold driving shaft 844 is arranged in an elongated hole formed in the thrusting plate link 841. The fold driving shaft 844 drives a thrusting plate 846 fixed to a thrusting plate fixation plate 845. The thrusting plate 846 is formed of a plate having a thickness of approximately 0.5 mm. The thrusting plate fixation plate 845 and the thrusting plate 846 constitute the thrusting member 30.

The shaft 843 is held in press contact with the outer periphery of the cam 847. When the cam shaft 839 rotates, the cam 847 also rotates, and the thrusting plate 846 approaches the vicinity of the nip of the upper and lower folding rollers 28 and 29. As a result, the thrusting plate 846 can force the sheet bundle into the nip of the upper and lower folding rollers 28 and 29.

A folding roller nip releasing device 861 for releasing the nip of the low-pressure folding roller pair will be described.

Figure 20B:
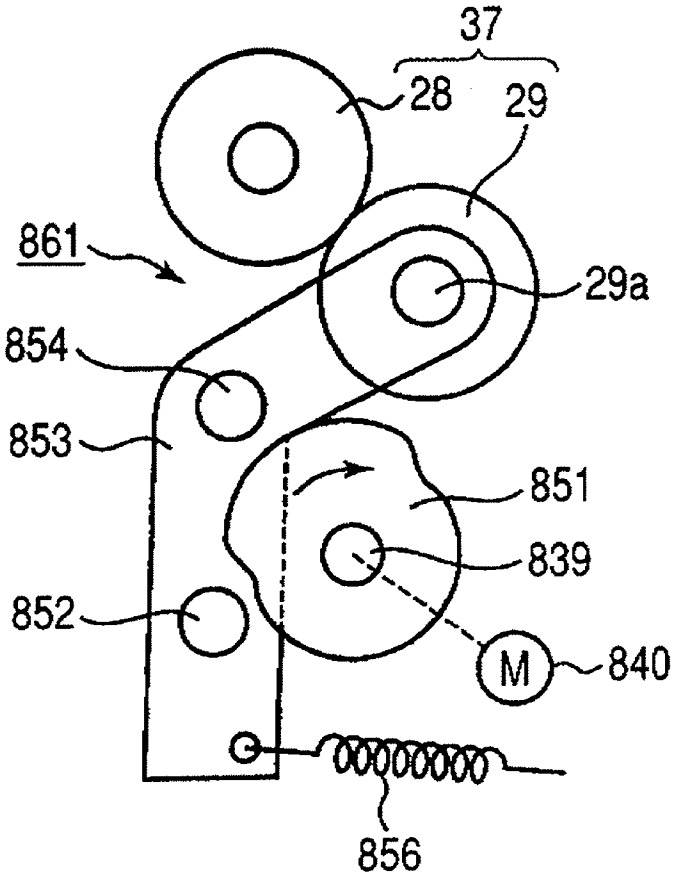
Figure 20A:
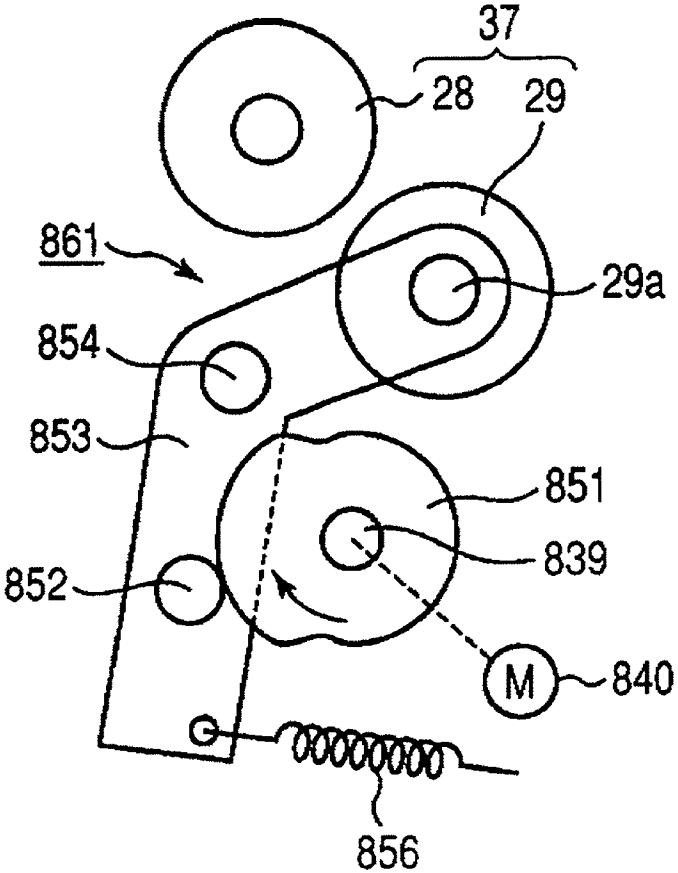

In FIGS. 20A and 20B, a cam 851 is fixed to the cam shaft 839. A link 853 is rotatably provided on a fulcrum shaft 854. The link 853 is pulled by a spring 856, and is urged counterclockwise. The link 853 is equipped with a shaft 852 held in press contact with the cam 851, and a rotation shaft 29*a* rotatably supporting the lower folding roller 29, with the fulcrum shaft 854 being therebetween. The upper folding roller 28 and the lower folding roller 29 constitute the low-pressure folding roller pair 37.

When the cam shaft 839 is rotated through rotation of the folding mechanism motor 840, the cam 851 rotates in the direction of the arrow, and the link 853 being pulled by the spring 856 rotates counterclockwise. Further, the lower folding roller 29 is brought into press contact with the upper folding roller 28 by the pulling force of the spring 856, and the rotation of the link 853 stops. At this time, the cam 851 is separated from the shaft 852.

Figure 22:
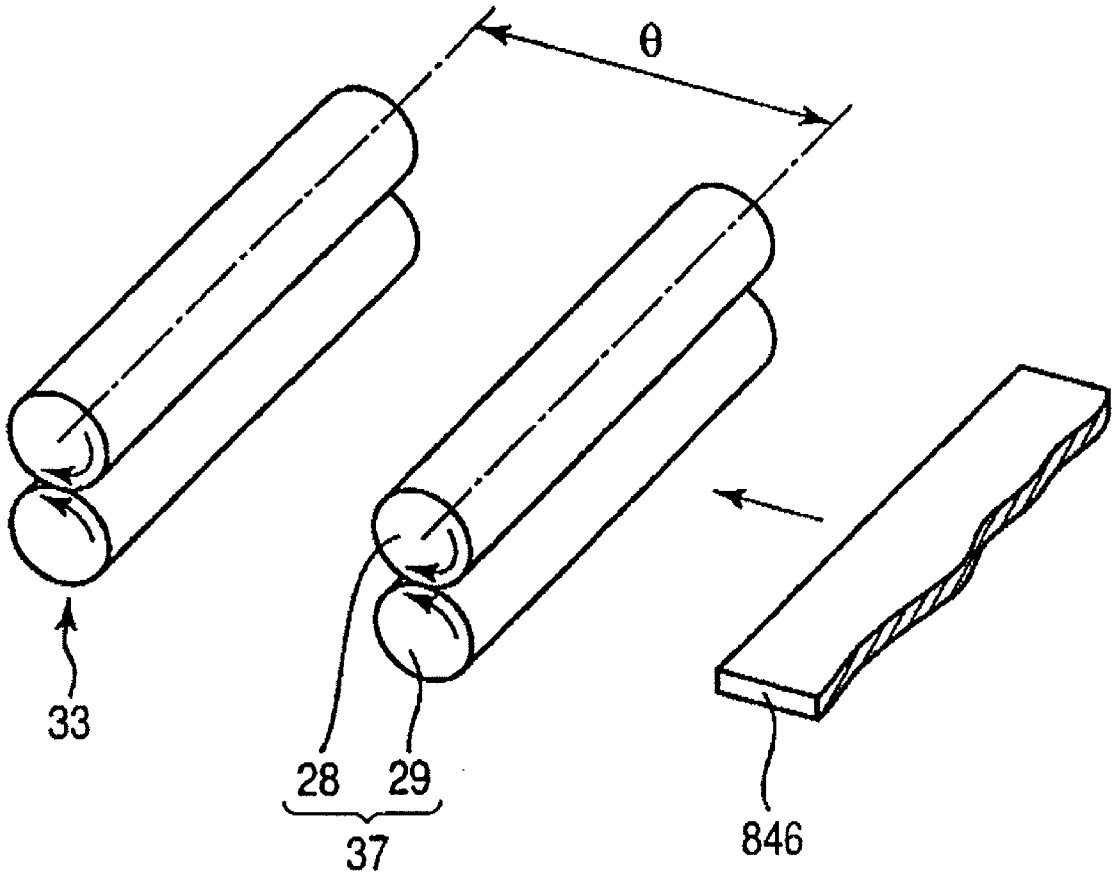
FIG. 22 is a diagram illustrating how a high-pressure folding roller pair is arranged so as to be inclined by an angle θ with respect to the low-pressure folding roller pair.

As shown in FIG. 22, the low-pressure folding roller pair 37 is arranged at right angles with respect to the sheet conveying direction. That is, the low-pressure folding roller pair 37 is arranged along the sheet width direction. However, the high-pressure folding roller pair 33 is arranged so as to be inclined by an angle θ with respect to the sheet width direction. That is, the high-pressure folding roller pair 33 is arranged so as to be inclined by the angle θ with respect to the low-pressure folding roller pair 37.

The sheet bundle folding operation will be described.

The sheet bundle stapled in the middle by the saddle stitching stapler 61 is grasped by the gripper 505, and is pulled to the movement position 505*c* for the gripper 505. Then, the folding mechanism motor 840 is started, and the upper roller 24*b* is lowered to hold the sheet bundle between the upper roller 24*b* and the lower roller 24*a*. After that, the gripper 505 is retracted to the upper, retracted position 505*d*, and, thereafter, avoids interference with the sheet bundle conveyed by the sheet bundle conveying roller pair 24 so that it may not hinder the conveyance of the sheet bundle. The fold conveyance guide pair 25, which is on the thrusting member side 30 with respect to the sheet bundle conveying roller pair 24, is curved downwardly, so the gripper 505 can be easily retracted.

The lower roller 24*a* and the upper folding roller 28 rotate so as to convey the sheet bundle to the right of FIGS. 1 and 16. The sheet bundle is held between the upper roller 24*b* and the lower roller 24*a*, and is conveyed to the low-pressure folding roller pair 37 through rotation of the lower roller 24*a*.

Figure 18A:
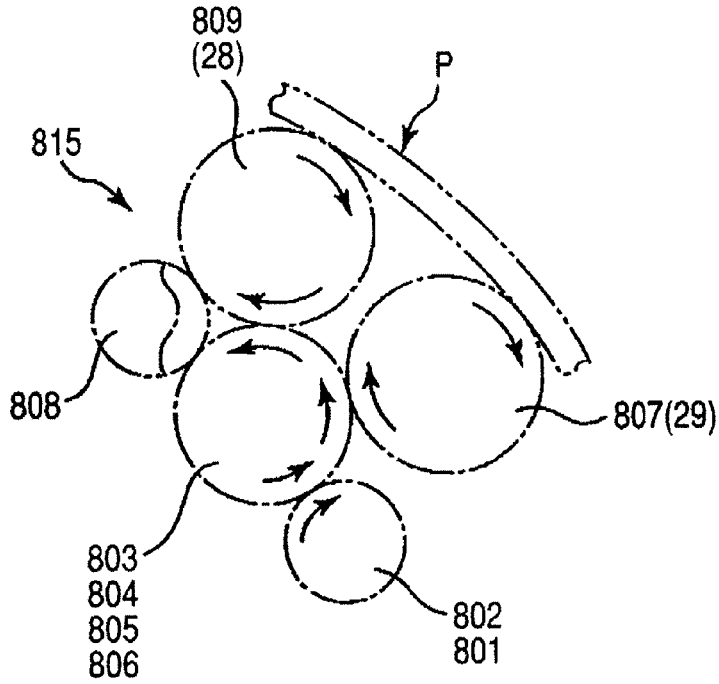
FIG. 18A is a diagram illustrating the low-pressure folding roller pair conveying a sheet bundle.

When the fold conveying motor 801 starts, and the lower roller 24*a* starts to rotate, the upper folding roller 28 and the high-pressure folding roller pair 33 also start rotation. At this time, as shown in FIG. 18A, the fold conveying motor 801 is rotating clockwise. The torque of the fold conveying roller 801 is transmitted to the upper folding roller 28 through the gears 802 and 803, the shaft 804, the one-way gear 805, and the gear 809, and the upper folding roller 28 rotates clockwise. The torque of the fold conveying motor 801 is also transmitted to the lower folding roller 29 through the gears 802, 803, and 807, and the lower folding roller 29 also rotates clockwise.

Since the upper and lower folding rollers 28 and 29 are both rotating clockwise, when the upper folding roller 28 and the lower folding roller 29 are in contact with each other, the rotating directions are opposite to each other where the rollers are in contact with each other, thereby mutually hindering the rotation. Thus, as shown in FIG. 20A, the lower folding roller 29 is separated from the upper folding roller 28 by the cam 851.

Thus, the upper folding roller 28 and the lower folding roller 29, separated from each other, rotate clockwise without damaging each other, and can convey the sheet bundle to the right as seen in FIGS. 1, 16, 18A, and 18B.

In the above-mentioned operation, the sheet bundle, whose conveyance is related from the gripper 505 to the sheet bundle conveying roller pair 24, is detected by the folding control sensor 26 while it is conveyed to the low-pressure folding roller pair 37. When, after the detection of the leading edge of the sheet bundle by the folding control sensor 26, a period of time long enough to cause the stapled portion of the sheet bundle to be opposed to the thrusting member 30 has elapsed, the fold conveying motor 801 is reversed, and the folding mechanism motor 840 rotates.

Figure 18B:
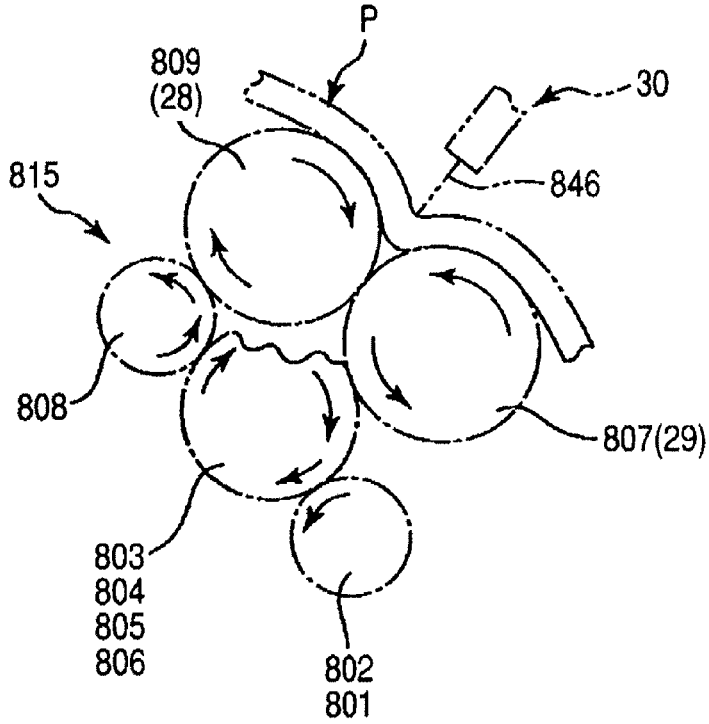
FIG. 18B is a diagram illustrating the low-pressure folding roller pair folding the sheet bundle into two.

When the fold conveying motor 801 is reversed (rotates counterclockwise) as shown in FIG. 18B, the torque of the fold conveying motor 801 is transmitted to the upper folding roller 28 through the gears 802 and 803, the shaft 804, the one-way gears 805 and 806, and the gears 808 and 809. As a result, in spite of the reversing of the fold conveying motor 801, the upper folding roller 28 continues clockwise rotation. The high-pressure folding roller pair 33 also continues rotation in the same direction. The torque of the reversed fold conveying motor 801 is also transmitted to the lower folding roller 29 through the gears 802, 803, and 807. Thus, the lower folding roller 29 is switched to counterclockwise rotation.

When the cam 851 is rotated by the folding mechanism motor 840, the lower folding roller 29 is brought into press contact with the upper folding roller 28 as shown in FIG. 20B.

Further, when the cam 847 is rotated by the folding mechanism motor 840, the thrusting plate 846 approaches the nip of the low-pressure folding roller pair 37 as shown in FIG. 21A.

While the operations of moving the upper roller 24*b* toward and away from the lower roller 24*a* and moving the lower folding roller 29 toward and away from the upper folding roller 28 and the operation of the thrusting plate 846 are conducted by one folding mechanism motor 840, it is also possible to conduct the three operations by individual motors.

In this way, the upper folding roller 28 rotates clockwise, and the lower folding roller 29 rotates counterclockwise, and the thrusting plate 846 approaches the nip of the rollers 28 and 29 thus held in press contact with each other, whereby the sheet bundle is forced into the nip of the low-pressure folding roller pair 37. The low-pressure folding roller pair 37 into which the sheet bundle has been forced rotates while holding the sheet bundle to fold the sheet bundle. Further, the sheet bundle is detected by the folding sensor 32 shown in FIG. 1. Then, the high-pressure roller pair 33 rotates while holding the sheet bundle, and discharges it onto the bundle stacking tray 35.

The conveyance of the sheet bundle is passed on to the high-pressure folding roller pair 33 already being rotated by the fold conveying motor 801. Immediately after the sheet bundle starts to be conveyed by the high-pressure folding roller pair 33, the folding mechanism motor 840 starts, and the lower folding roller 29 of the low-pressure folding roller pair 37 is separated from the upper folding roller 28 thereof as shown in FIG. 20A. Thus, even if there is a difference between the sheet bundle conveying speed of the low-pressure folding roller pair 37 and the sheet bundle conveying speed of the high-pressure folding roller pair 33, the sheet bundle is neither pulled or contracted, and is conveyed smoothly. In this case, the folding mechanism motor 840 is set so as to start when a predetermined period of time has elapsed after the detection of the sheet bundle by the fold sensor 32 and the sheet bundle has been caught by the high-pressure folding roller pair 33.

At this time, the pressure with which the sheet bundle is held by the high-pressure folding roller pair 33 is set higher than the pressure with which the sheet bundle is held by the low-pressure folding roller pair 37. Thus, the sheet bundle is folded to some degree by the low-pressure folding roller pair 37, and is then finally folded by the high-pressure folding roller 33. Thus, the folding device 31 does not forcibly fold the sheet bundle and can reliably bend the sheet bundle without damaging it. Further, it is not necessary for the folding device 31 to be of a firm structure.

Further, the high-pressure folding roller pair 33 is inclined with respect to the sheet bundle conveying direction by the angle $\alpha$, so the folded portion of the sheet bundle passes the high-pressure folding roller pair 33 being pressurized, starting from one end of the nip of the high-pressure folding roller pair 33 to the other end of the nip thereof. Thus, the folded portion of the sheet bundle is folded reliably. Further, since the folded portion of the sheet bundle is successively held and pressurized starting from one end of the nip of the high-pressure folding roller pair 33 to the other end thereof, the load applied to the fold conveying motor 801 is small, and the requisite drive force of the fold conveying motor 801 is small. It is not necessary for the high-pressure folding roller pair 33 to be inclined.

Finally, the sheet bundle is discharged onto the bundle stacking tray 35.

Figure 23:
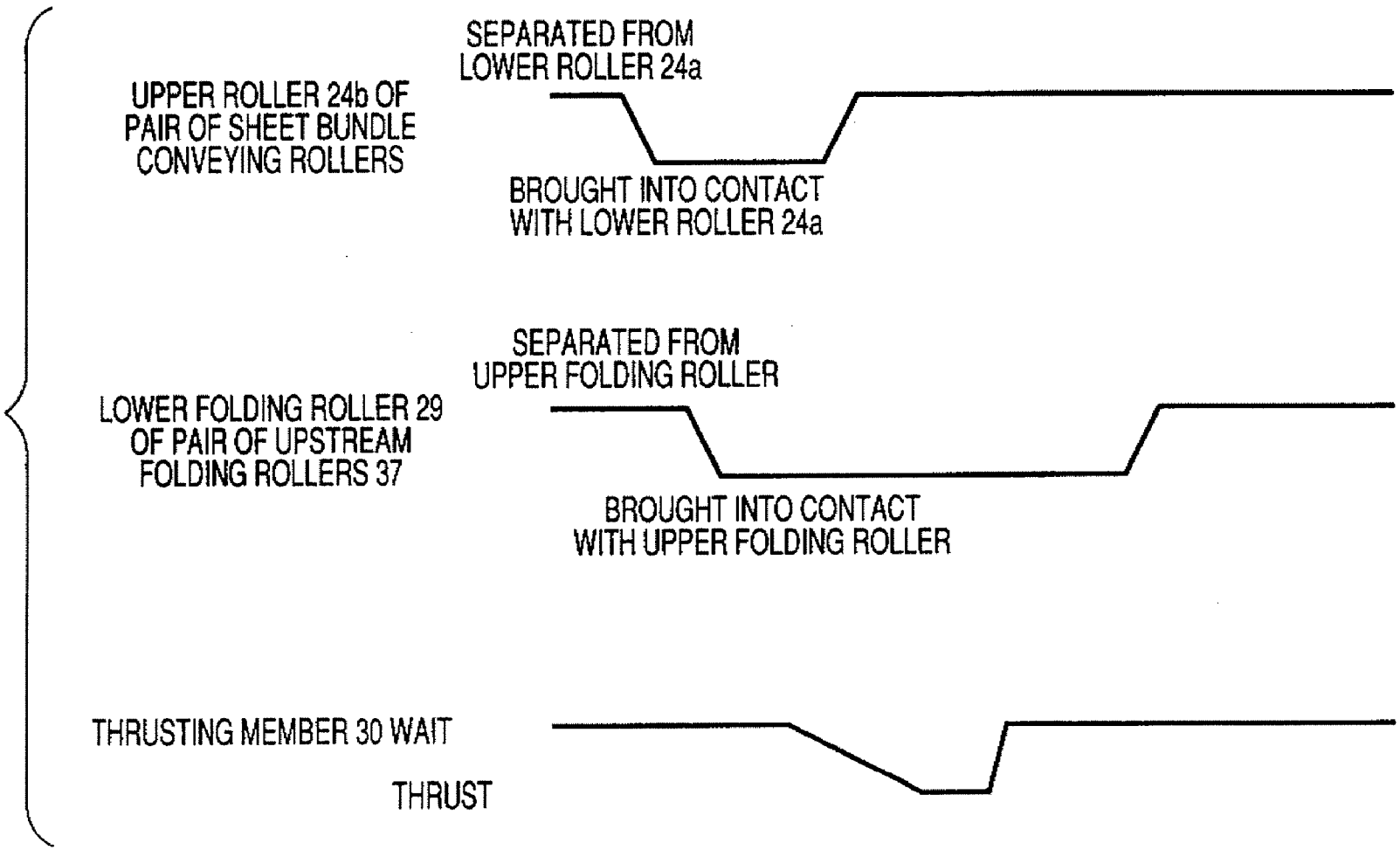
FIG. 23 is a diagram illustrating an operating order of the sheet bundle conveying roller pair, the low-pressure folding roller pair, and a thrusting plate.

In the above-mentioned description, the operation of bringing the upper roller 24*b* of the sheet bundle conveying roller pair 24 into contact with the lower roller 24*a* thereof, the operation of bringing the lower folding roller 29 into contact with the upper folding roller 28, and the thrusting operation of the thrusting member 30 are conducted in the order as shown in FIG. 23. That is, those operations are conducted in the following order. The operation of bringing the upper roller 24*b* of the sheet bundle conveying roller pair 24 into contact with the lower roller 24*a* thereof, the operation of bringing the lower folding roller 29 into contact with the upper folding roller 28, and the thrusting operation of the thrusting member 30.

Further, as shown in FIGS. 19A, 19B, 20A, 20B, and 21A through 21C, the cams 838, 851, and 847 are fixed to the cam shaft 839. The cams 838, 851, and 847 are configured so as to operate each portion in the operational order as shown in FIG. 23.

(Control Block Diagram)

Figure 24:
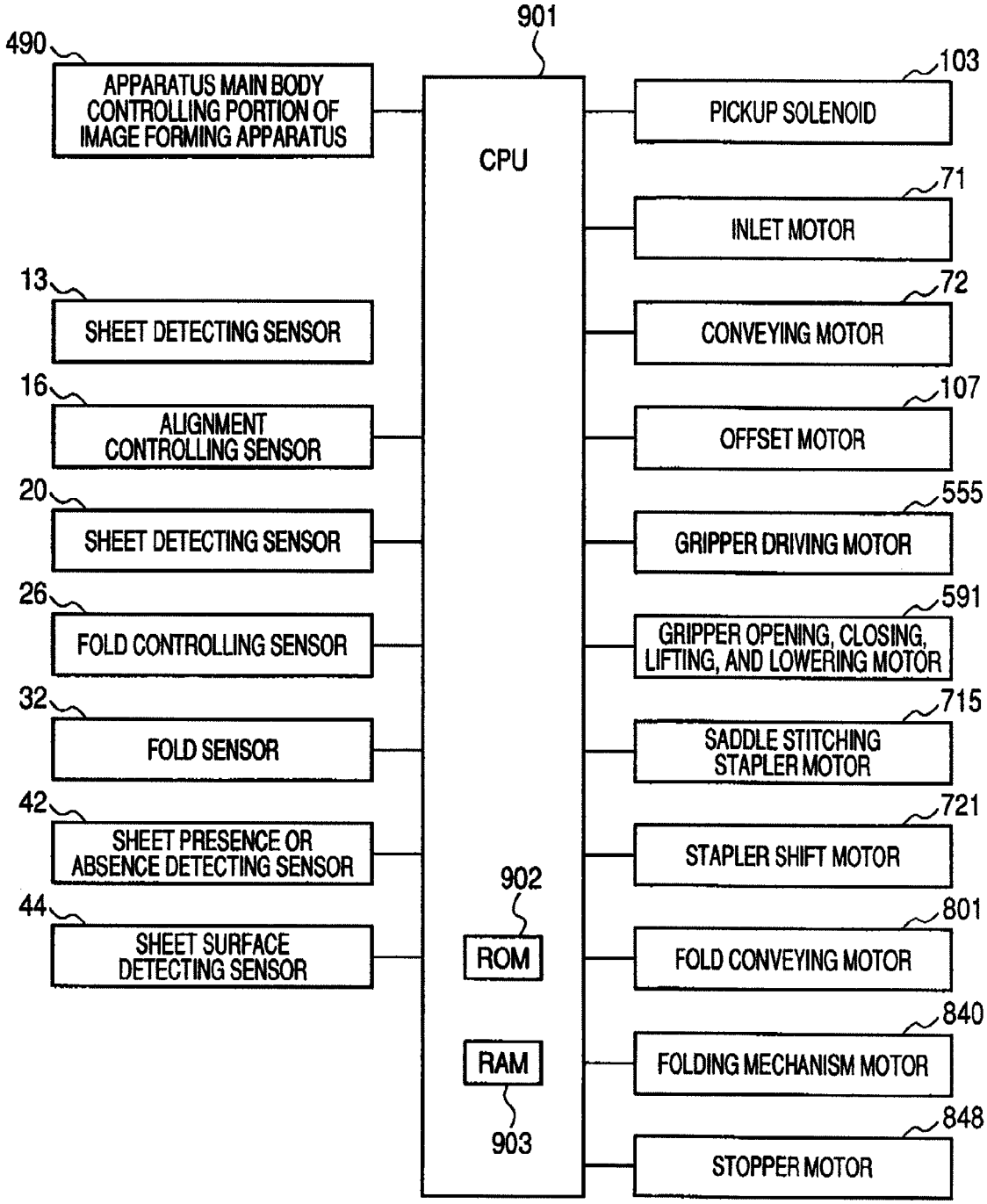
FIG. 24 is a control block diagram for a finisher.

FIG. 24 is a block diagram illustrating the configuration of the control portion of the finisher 11.

A CPU 901 effects signal exchange with the control portion 490 of the apparatus main body 402 to control the finisher 11. Provided in the CPU 901 are a ROM 902 storing the sequence for each portion, that is, a program corresponding to the control procedures shown in FIGS. 25A and 2B, and a RAM 903 storing at one time various items of information as needed. One of the CPU 901 and the control portion 490 of the apparatus main body may be integrated with the other.

Sensors, motors, and a solenoid are connected to the CPU 901, and the motors and plungers are controlled based on information from the sensors.

The sensors connected include: a sheet detecting sensor 13 provided in the vicinity of the inlet of the finisher 11 and adapted to detect a sheet supplied from the apparatus main body 402 of the copying machine 401; the alignment controlling sensor 16 serving to detect the sheet conveyed from the inlet of the finisher 11 to the processing tray 19 to provided operational timing for the side alignment plate 66, and to operate the pickup solenoid 103; the sheet detecting sensor 20 for detecting the presence/absence of a sheet on the processing tray 19; the fold controlling sensor 26 arranged between the saddle stitching stapler 61 and the low-pressure folding roller pair 37 and adapted to detect the sheet bundle stapled by the saddle stitching stapler 61 and conveyed to the low-pressure folding roller pair 37; the fold sensor 32 for detecting the sheet bundle folded by the low-pressure folding roller pair 37 and conveyed to the high-pressure folding roller pair 33 from the low-pressure folding roller pair 37; a sheet presence/absence detecting sensor 42 for detecting any sheet stacked on the lifting and lowering tray 41; the sheet surface detecting sensor 44 for detecting the upper surface of the lifting and lowering tray 41 with no sheet or sheet bundle stacked thereon or the upper surface of a sheet or a sheet bundle stacked on the lifting and lowering tray 41; and the saddle stitching stapler home position sensor 731 for effecting positioning the saddle stitching stapler at the home position.

The motors connected include: an inlet motor 71 for rotating the inlet conveying roller pair 14; the conveying motor 72 for rotating the intermediate conveying roller pair 15, the discharge conveying roller pair 17, and the offset roller 18; the offset motor 107 for moving the offset roller 18 in the sheet width direction; the gripper unit driving motor 555 for moving the gripper unit 21 in the sheet conveying direction; the gripper opening, closing, lifting, and lowering motor 591 for opening, closing, lifting, and lowering the gripper 505; the saddle stitching stapler motor 715 for lifting and lowering the staple driving portion 63 of the saddle stitching stapler 61; the stapler shift motor 721 for moving the staple driving portion 63 of the saddle stitching stapler 61 in the sheet width direction; the fold conveying motor 801 for rotating the sheet bundle conveying roller pair 24, the low-pressure folding roller pair 37, and the high-pressure folding roller pair 33; the folding mechanism motor 840 for moving the upper roller 24*b* toward and away from the lower roller 24*a*, moving the lower folding roller 29 toward and away from the upper folding roller 28, and operating the thrusting plate 846; and the stopper motor 848 for operating the trailing edge stopper 23.

As the solenoid, there is used the pickup solenoid 103 for lifting and lowering the offset roller 18.

(Operation of the Finisher as a Whole)

Figures 25, 25A:
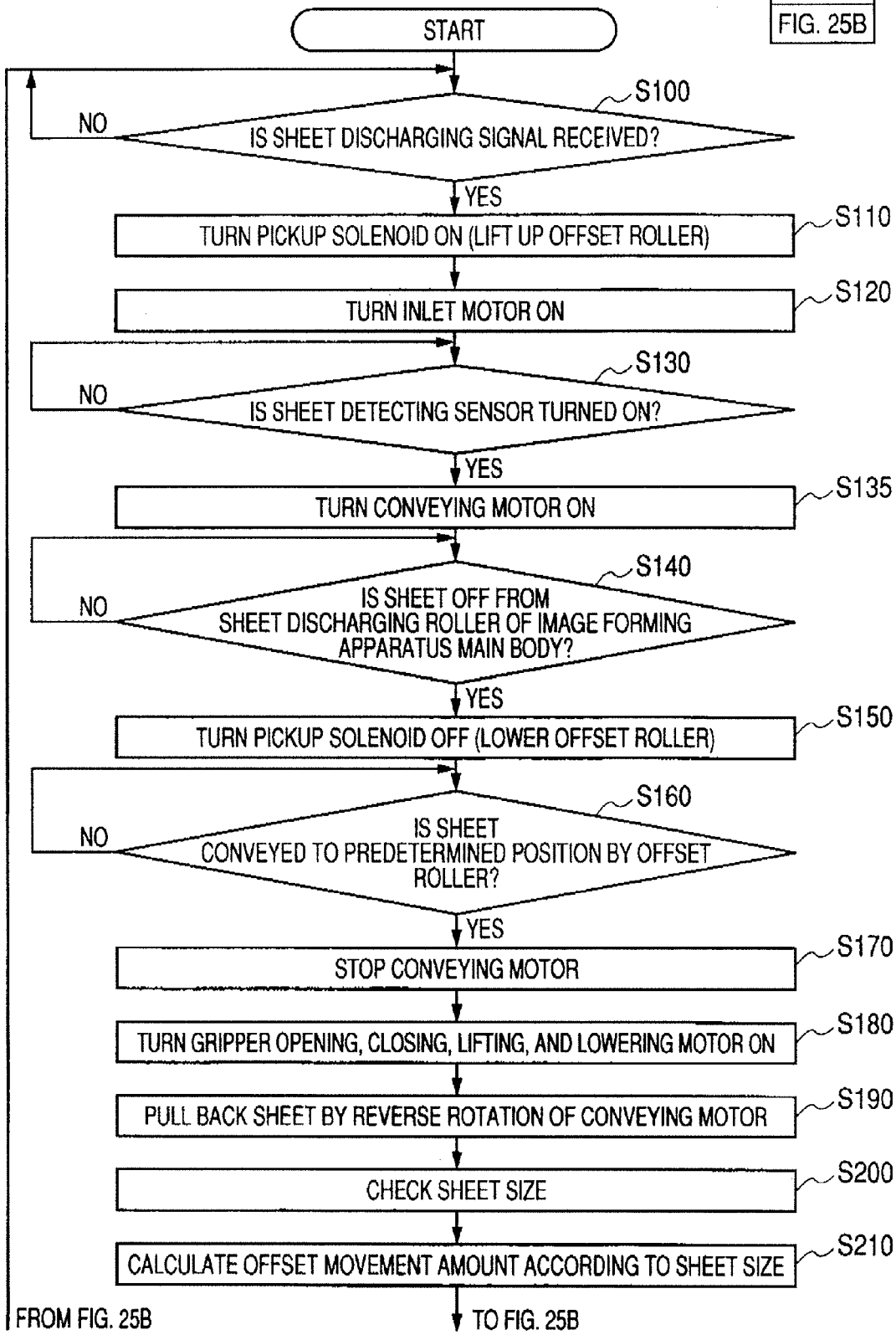
FIG. 25 which is composed of FIGS. 25A and 25B are flowcharts for illustrating operation of the finisher.

When the apparatus main body 402 of the copying machine 401 starts image forming operation, the CPU 901 of the finisher 11 checks as to whether a sheet discharge signal has been received from the control portion 490 of the apparatus main body 402 (FIGS. 25A and 25B, Step S100).

Figure 2:
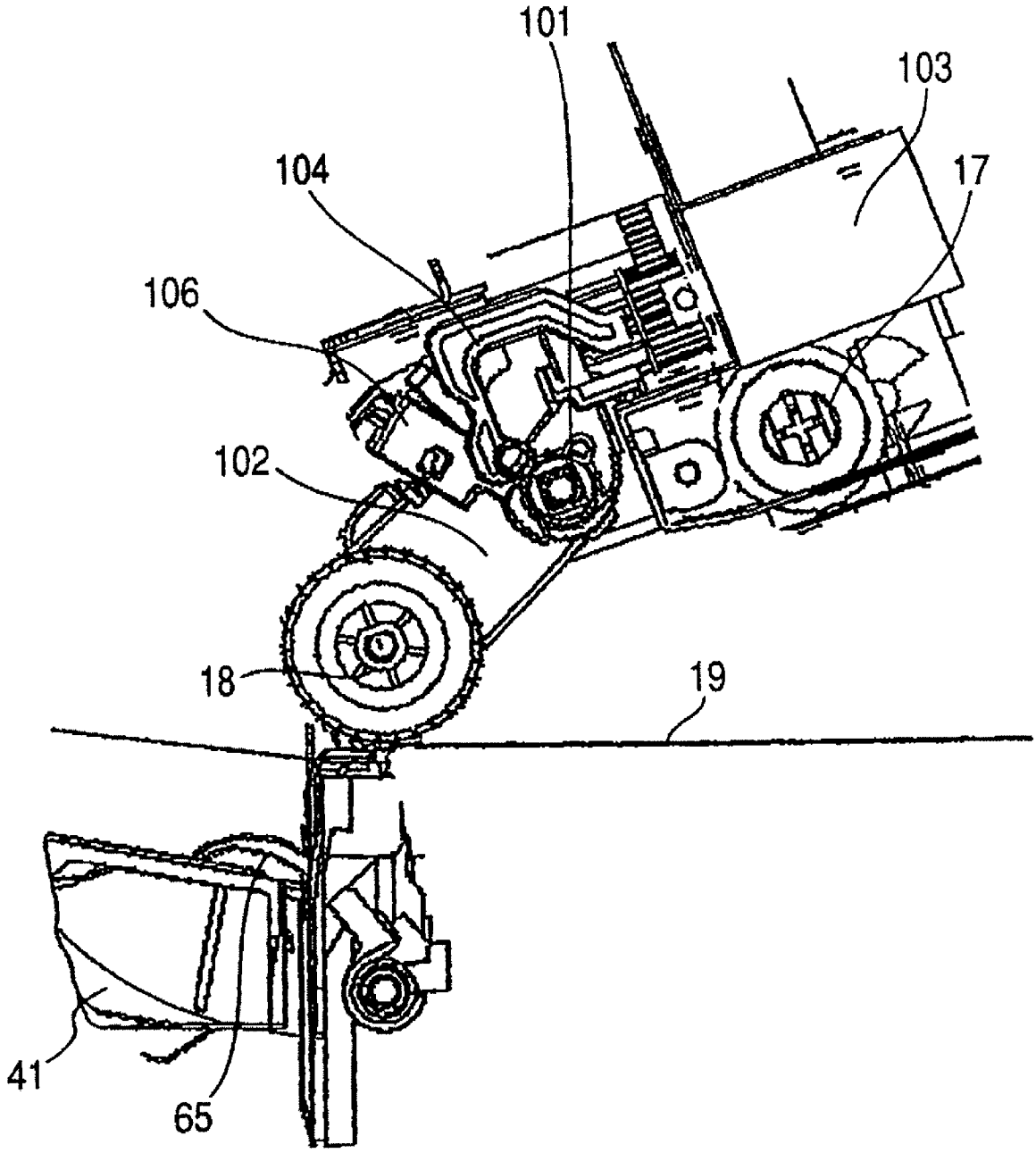
FIG. 2 is an enlarged view of an offset roller of FIG. 1 and a portion in the vicinity thereof.

When a sheet discharge signal has been received (i.e., the answer in Step S100 is YES), the CPU 901 turns on the pickup solenoid 103 of FIGS. 2 and 3 (Step S110), and lifts up the offset roller 18. The CPU 901 turns on the inlet motor 71 (Step S120). The inlet conveying roller pair 14 conveys the sheet to the intermediate conveying roller pair 15.

When the leading edge of the first sheet passes the sheet detecting sensor 13 of FIG. 1 to turn on the sheet detecting sensor 13 (i.e., the answer in Step S130 is YES), the CPU 901 turns on the conveying motor 72 (Step S135). Then, the intermediate roller pair 15, the discharge conveying roller pair 17, and the offset roller 18 rotate. When the trailing edge of the sheet leaves the discharge roller pair 417 of the apparatus main body 402 (i.e., the answer in Step S140 is YES), the delivery of the sheet from the apparatus main body 402 to the finisher 11 is completed.

Figure 27A:
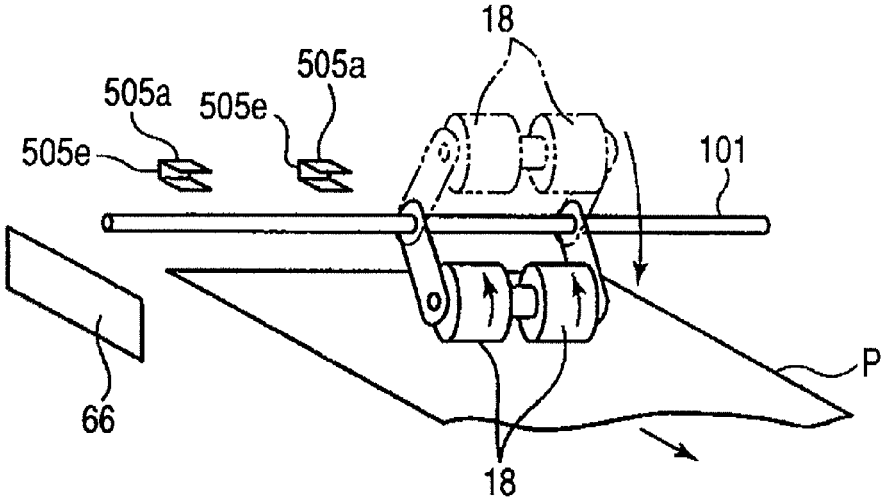
FIGS. 27A, 27B, and 27C are diagrams for illustrating operation of the offset roller.

Before the sheet leaves the intermediate conveying roller pair 15, the CPU 901 turns off the pickup solenoid 103 (Step S150), and causes the offset roller 18 to land on the sheet by its own weight (see FIG. 27A). After that, the offset roller 18 conveys the sheet to the predetermined position on the left-hand side of FIG. 1 by the conveying motor 72 (Step S160). Then, when the offset roller 18 conveys the sheet to the predetermined position (i.e., the answer in Step S160 is YES), the CPU 901 stops the rotation of the conveying motor 72 (Step S170), and stops the conveyance of the sheet S.

Next, when the rotation of the offset roller 18 stops, the gripper opening, closing, lifting, and lowering motor 591 shown in FIG. 7 is turned on (Step S180), and the gripper 505 is opened. After that, the conveying motor 72 is reversed, and the sheet is conveyed into the right direction of FIG. 1 by the offset roller 18. The offset roller 18 pulls back the sheet S (Step S190), and causes the trailing edge of the sheet (the right-hand end of FIG. 1) to abut the reference wall 505*e*.

As shown in FIG. 26, at this time, the gripper 505 is on standby at the home position 505*a*. The side stitching stapler 22 and the staple driving portion 63 of the saddle stitching stapler are on standby outside the sheet conveying region PA.

Figure 27B:
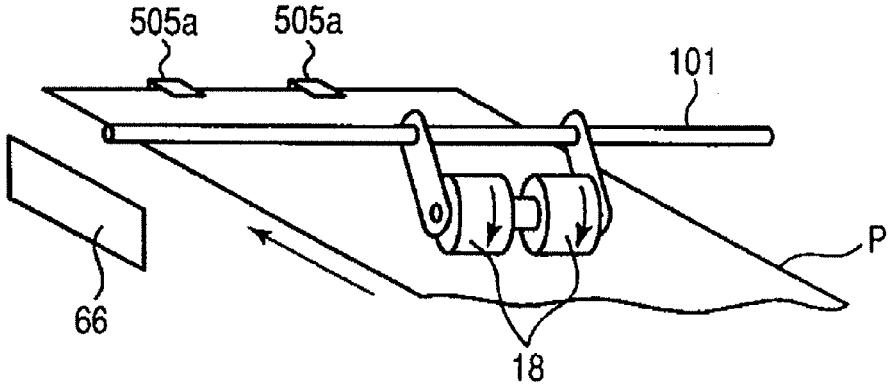

Even after causing the trailing edges of the sheets to abut the reference wall 505*e* of the gripper 505 in the open state, the offset roller 18 slips on the sheet to continue rotation to some degree (see FIG. 27B). As a result, the sheet is reliably caused to abut the reference wall 505*e*, and any skew feed thereof is corrected, and the sheet edge is aligned in the sheet conveying direction.

The CPU 901 checks the sheet size based on sheet size information from the apparatus main body 402 (Step S200), and calculates the offset movement amount, which is the requisite moving amount in the sheet width direction for pressing the sheets discharged onto the processing tray 410 against the side alignment plate 66 (Step S210).

Figure 27C:
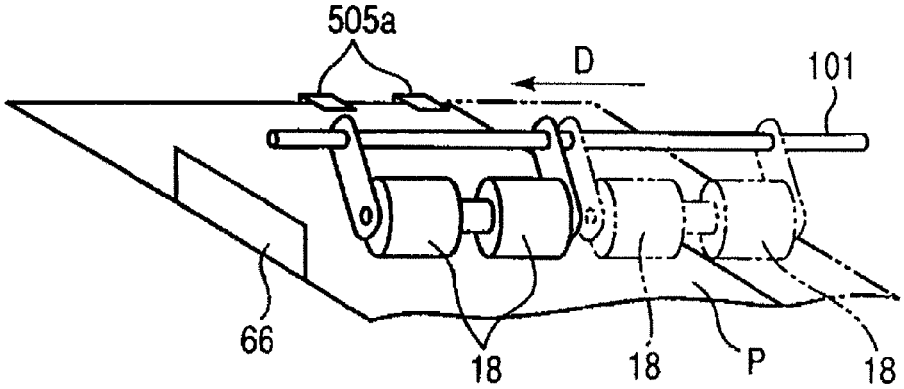

Next, the CPU 901 drives the offset motor 107 (see FIG. 3). Then, the pinion 109 (see FIG. 3) rotates, and, due to the rack 110, the offset roller 18 moves in the direction indicated by the arrow D of FIGS. 3 and 27C by an amount somewhat larger than the offset movement amount (Step S220). At this time, the offset roller 18 moves the sheet in the direction of the arrow D through friction with the sheet, and causes the side edge of the sheet to abut the side alignment plate 66. After having caused the sheet S to abut the side alignment plate 66, the offset roller 18 slips on the sheet S to some degree before stopping (see FIG. 27C). As a result, the side edge of the sheet is reliably aligned.

While in the above-mentioned example width alignment is effected by using one side of the sheet as a reference, it is also possible to effect width alignment by matching the width center of the sheet with the width center of the conveying guide pair 12.

When the alignment of the first sheet S is thus completed, the CPU 901 turns on the pickup solenoid 103 (Step S240), and lifts up the offset roller 18 before turning off the gripper opening, closing, lifting, and lowering motor 591, whereby the gripper 505 is closed, and the sheets P already aligned are held by the gripper 505 (Step S250). As a result, it is possible to prevent the sheet S discharged first from being brought into the left direction of FIG. 1 by the sheet discharged next.

In its lifted state, the offset roller 18 is restored to the home position by the offset motor 107 through the meshing engagement of the rack 110 and the pinion 109 (see FIG. 3) (Step S260).

The CPU 901 checks whether the sheet S on the processing tray 19 is the final sheet corresponding to the final page of the document to be copied (Step S270). When it is determined, based on information supplied from the apparatus main body 402 of the copying machine, that the sheet is not the final sheet S (i.e., the answer in Step S270 is NO), the procedure for the CPU 901 returns to Step S100, and the above-mentioned operation is repeated until the sheet turns out to be the final sheet S.

When it is determined by the CPU 901 that the sheet is the final sheet (i.e., the answer in Step S270 is YES), it means that there is stacked on the processing tray 19 a bundle of sheets in a number corresponding to the number of originals read by the image reading apparatus 403. Next, the CPU 901 checks whether stapling process has been selected or not (Step S280). In a case where it has been selected (i.e., the answer in Step S280 is YES), one of the saddle stitching stapler 61 and the side stitching stapler 22 is driven to execute stapling process (Step S290).

In a case where no stapling process has been selected (i.e., the answer in Step S280 is NO), or after side stitching stapling process has been completed, the CPU 901 operates the gripper opening, closing, lifting, and lowering motor 591, and grasps the sheet bundle by the gripper 505, Further, the CPU 901 controls the gripper unit driving motor 555 to cause the gripper 505 to advance toward the lifting and lowering tray 41, and drives the stopper motor 848 to cause the trailing edge stopper 23 to protrude over the processing tray 19 before moving the gripper 505 to the right. As a result, the sheet bundle S is discharged onto the lifting and lowering tray 41 (Step S300). Further, the CPU 901 thrusts the trailing edge stopper 23 (Step S305), and lowers the lifting and lowering tray 41 in synchronism with the sheet bundle S discharging motion (Step S310). After that, the CPU 901 returns the gripper 505 to the home position (Step S320), and lowers the trailing edge stopper 23 (Step S325).

Further, thereafter, in order to stop the rotation of the intermediate conveying roller pair 15 and the offset roller pair 18, the CPU 901 stops the conveying motor 72 (Step S330), and turns off the pickup solenoid 103 (Step S340), whereby the offset roller 18 is lowered, and the series of operations are completed.

(Side Stitching of the Sheet Bundle)

In Step S290 of FIGS. 25A and 25B, when an end portion of the sheet bundle is to be stapled, the CPU 901 completes the alignment of the sheets, and then, as shown in FIG. 26, moves the gripper 505 to the movement position 505*c*.

The CPU 901 retracts the staple driving portion 63 of the saddle stitching stapler 61 and the side stitching stapler 22 from the stapler movement region SA in advance. After that, the CPU 901 causes the staple driving portion 63 of the saddle stitching stapler 61 to approach the side stitching stapler 22. At the position indicated by the dashed lines in FIG. 26, the staple driving portion 63 is coupled with the side stitching stapler 22 by the connecting claw 712*a* (see FIG. 14). The side stitching stapler 22 is pulled by the staple driving portion 63 to move to the stapling processing position, and staples the sheet bundle at that position. The stapling is effected at one or multiple positions. Further, it is also possible for the side stitching stapler 22 to be formed so as to be capable of oscillating, enabling a corner portion of the sheet bundle to be stapled.

After the gripper 505 has moved to the movement position 505*c*, the sheet bundle on the processing tray 19 is released by the gripper 505 but is pressed against the processing tray 19 by the offset roller 18. Thus, it is possible to prevent misalignment of the sheet bundle on the processing tray 19 when the side stitching stapler 22 performs stapling operation.

After having stapled the sheet bundle, the side stitching stapler 22 is retracted to the exterior of the sheet conveying region PA by the staple driving portion 63 of the saddle stitching stapler. Further, the staple driving portion 63 of the saddle stitching stapler is on standby at the position indicated by dashed lines shown in FIG. 26. It is also possible for the stale driving portion 63 to be on standby outside the sheet conveying region PA indicated by the solid lines. After that, the gripper 505 moves to the movement position 505*c* to the sheet bundle discharging position 505*b* to discharge the sheet bundle.

The staple driving portion 63 of the saddle stitching stapler is retracted to the side opposite to the side stitching stapler 22. However, since the staple driving portion 63 can be lifted and lowered, it does not interfere with the gripper 505 if it remains in the sheet conveying region PA in the lowered state.

(Saddle Stitching of the Sheet Bundle)

The sheet bundle that has undergone end alignment and width alignment is grasped by the gripper 505 and is moved by being pulled to the right of FIG. 26. When the portion of the sheet bundle to be stapled moves to a position directly below the clincher, the gripper 505 stops the conveyance while grasping the sheet bundle.

Figure 28A:
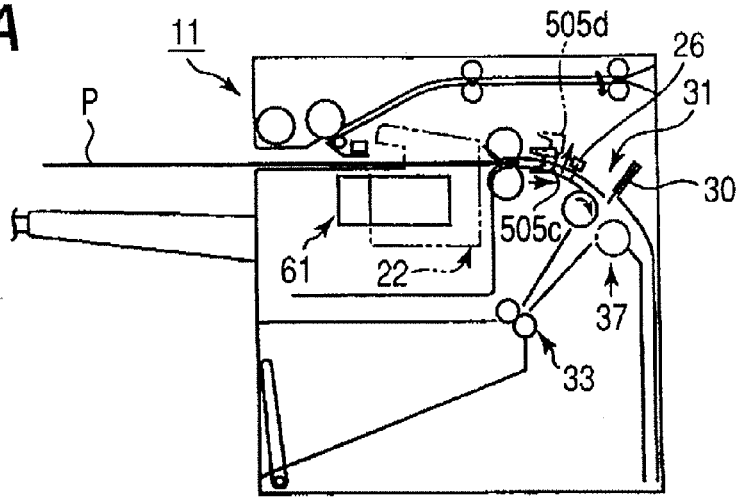
Figure 28B:
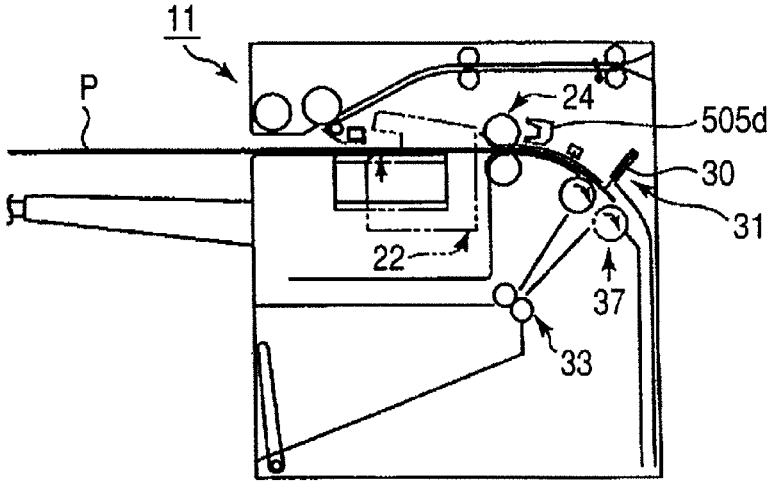

Depending on the sheet length, the gripper 505 is retracted to the retracted position 505*d*, and the sheet bundle conveying roller pair 24 conveys the sheet bundle (see FIG. 28A). The distance through which the sheet bundle is conveyed is calculated based on sheet size information supplied from the apparatus main body 402. Further, the staple driving portion 63 of the saddle stitching stapler moves to a position directly below the clincher 62, and performs saddle stitching on the sheet bundle (see FIG. 28B). At this time, the gripper 505 is outside the stapler moving region SA, so it does not interfere with the staple driving portion 63.

(Folding of the Sheet Bundle)

Figure 28C:
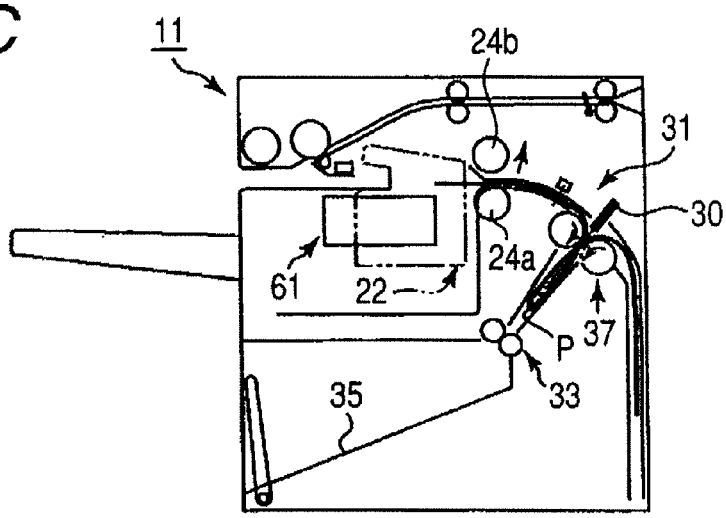

The sheet bundle that has undergone saddle stitching is folded into two and discharged through the rotations of the sheet bundle conveying roller pair 24, the low-pressure folding roller pair 37, the thrusting operation of the thrusting member 30 (see FIG. 28C), and the rotation of the high-pressure folding roller pair 33. When the sheet bundle is passed on from the low-pressure folding roller pair 37 to the high-pressure folding roller pair 33 and conveyed, the nip of the low-pressure roller pair 37 is canceled after the sheet bundle is passed on to the high-pressure folding roller pair 33.

With the following arrangement, the above-mentioned finisher 11 can be reduced in size. That is, the staple driving portion 63 of the saddle stitching stapler 61 and the side stitching stapler 22 move on the common rail 701*a*, so the saddle stitching stapler 61 and the side stitching stapler 22 are arranged in the sheet width direction. Side stitching is not performed by the saddle stitching stapler 61 but by the side stitching stapler 22 of firm structure, so there is no need for the saddle stitching stapler 61 to be of a firm structure allowing side stitching. Further, the saddle stitching stapler 61 is coupled with the side stitching stapler 22 by the connecting claw 712*a*, and the side stitching stapler 22 is moved in the sheet width direction, so a single drive source suffices.

While in the finisher of this embodiment the CPU 901 performs control while reading a program written to the ROM (or RAM) shown in the flow chart, the same effect can also be achieved when the processing of the control program is performed by hardware.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-127114, filed Apr. 28, 2006 and No. 2006-127115 filed Apr. 28, 2006, which are hereby incorporated by reference herein in their entirety.

What is claimed is:

1. A sheet processing apparatus, comprising:

a saddle stitching stapler including a staple driving portion movable in a sheet width direction and a staple clinching portion arranged at a saddle stitching position in the sheet width direction, and adapted to staple a middle portion of a sheet bundle by causing the staple driving portion to approach the staple clinching portion after the staple driving portion moves to the saddle stitching position;

a side stitching stapler including a staple driving portion and a staple clinching portion pivoted to each other, and adapted to staple an end portion of the sheet bundle by holding the end portion between the staple driving portion and the staple clinching portion after the staple driving portion and the staple clinching portion move to a side stitching position in the sheet width direction; and a rail on which the side stitching stapler and the saddle stitching stapler are aligned, said rail extending in the sheet width direction, said staple driving portion of said saddle stitching stapler and said side stitching stapler being on standby outside a sheet conveying region on said rail, wherein when the middle portion of the sheet bundle is stapled, said side stitching stapler is not used and said saddle stitching stapler is moved on said rail to a position in the sheet conveying region, and said saddle stitching stapler is used to staple the middle portion of the sheet bundle, and when the end portion of the sheet bundle is stapled, said saddle stitching stapler is not used and said side stitching stapler is moved on said rail to a position in the sheet conveying region, and said side stitching stapler is used to staple the end portion of the sheet bundle.

2. A sheet processing apparatus according to claim 1, wherein the staple clinching portion of the saddle stitching stapler is arranged on an upstream side of the staple driving portion and the staple clinching portion of the side stitching stapler in a sheet bundle conveying direction.

3. A sheet processing apparatus according to claim 1, further comprising a gripper which grasps the sheet bundle and conveys the sheet bundle in a sheet bundle conveying direction, wherein when the sheet bundle is conveyed by the gripper, at least the side stitching stapler is retracted to an exterior of the sheet conveying region where the sheet bundle is conveyed.

4. A sheet processing apparatus according to claim 1, further comprising an alignment unit for aligning an edge of a sheet along the sheet width direction.

5. An image forming apparatus, comprising:

an image forming portion for forming an image on a sheet; and a sheet processing apparatus as recite in claim 1 for processing the sheet on which the image has been formed by the image forming portion.

* * * * *